US006481967B2

(12) United States Patent
Tomita et al.

(10) Patent No.: US 6,481,967 B2
(45) Date of Patent: Nov. 19, 2002

(54) GAS TURBINE MOVING BLADE

(75) Inventors: Yasuoki Tomita, Takasago (JP); Yukihiro Hashimoto, Takasago (JP); Kiyoshi Suenaga, Takasago (JP); Hisato Arimura, Takasago (JP); Shunsuke Torii, Takasago (JP); Jun Kubota, Takasago (JP); Akihiko Shirota, Takasago (JP); Sunao Aoki, Takasago (JP); Tatsuo Ishiguro, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/790,975

(22) Filed: Feb. 23, 2001

(65) Prior Publication Data

US 2001/0016163 A1 Aug. 23, 2001

(30) Foreign Application Priority Data

Feb. 23, 2000 (JP) ..... 2000-046375
Mar. 24, 2000 (JP) ..... 2000-084988

(51) Int. Cl.[7] ..... F01D 5/18
(52) U.S. Cl. ..... 416/97 R; 415/115
(58) Field of Search ..... 416/96 R, 96 A, 416/97 R, 193 A, 219 R, 220 R; 415/115

(56) References Cited

U.S. PATENT DOCUMENTS 3,628,885 A * 12/1971 Sidenstick et al. ..... 156/504
3,966,357 A * 6/1976 Corsmeier ..... 416/500
4,073,599 A * 2/1978 Allen et al. ..... 416/232
4,130,373 A * 12/1978 Giles ..... 415/1
4,247,254 A * 1/1981 Zelahy ..... 415/115
4,815,928 A * 3/1989 Pineo et al. ..... 415/17
5,271,715 A * 12/1993 Zelesky et al. ..... 416/96 R
5,827,047 A * 10/1998 Gonsor et al. ..... 416/193 A
5,947,687 A * 9/1999 Mori et al. ..... 416/193 A
5,975,851 A * 11/1999 Liang ..... 415/115
6,190,128 B1 * 2/2001 Fukuno et al. ..... 416/223 A
6,196,799 B1 * 3/2001 Fukue et al. ..... 416/223 A

* cited by examiner

*Primary Examiner*—Edward K. Look
*Assistant Examiner*—Igor Kershteyn
(74) *Attorney, Agent, or Firm*—Wenderoth, Lind & Ponack, L.L.P.

(57) ABSTRACT

A gas turbine moving blade is provided which prevents occurrence of cracks caused by thermal stresses due to temperature differences between a blade and a platform while the gas turbine is being stopped. During steady operation time of the moving blade, cooling air enters cooling passages to flow through other cooling passages for cooling the blade, and then to flow out of the blade. A recessed portion having a smooth curved surface is provided in the platform near a blade fitting portion on the blade trailing edge side. A fillet of the blade fitting portion on the blade trailing edge side has a curved surface with curvature larger than that of a conventional blade fitting portion. A hub slot below the fillet, for blowing air, has a cross sectional area larger than other slots of the blade trailing edge. A thermal barrier coating is applied to the blade surface. By the above construction, thermal stresses due to temperature differences between the blade and the platform during gas turbine stoppage are made smaller and occurrence of cracks is prevented.

13 Claims, 14 Drawing Sheets

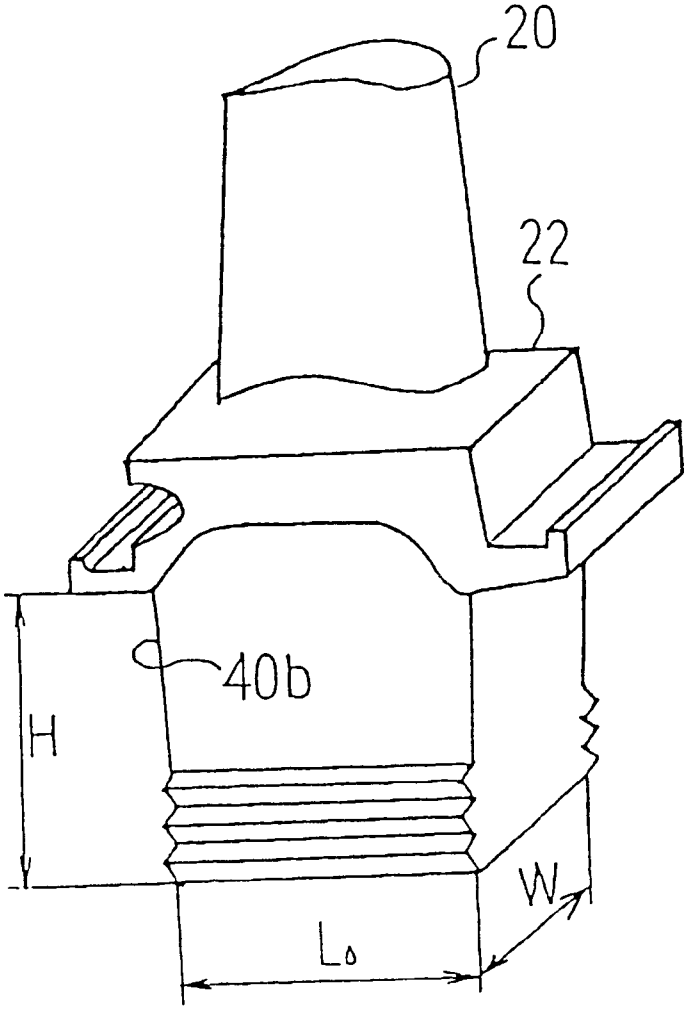
Fig. 4 (b)
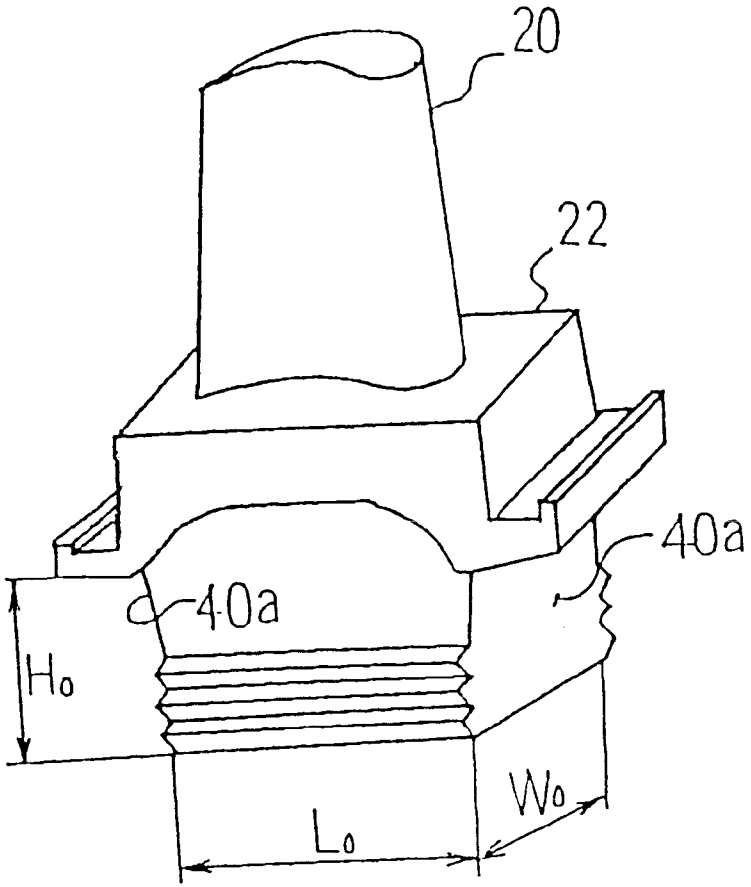
Fig. 4 (a) PRIOR ART

Fig. 10(b)
PRIOR ART
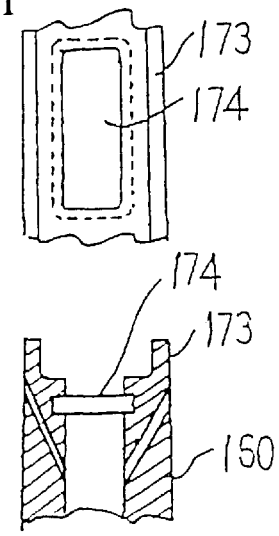
Fig. 10 (a)
PRIOR ART
Fig. 10 (d)
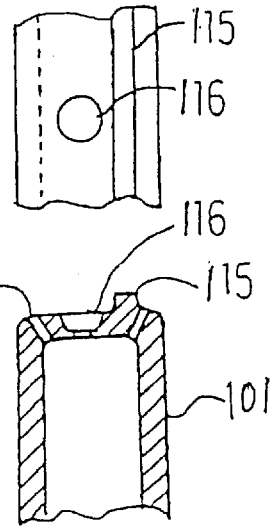
Fig. 10 (C)
Fig. 11
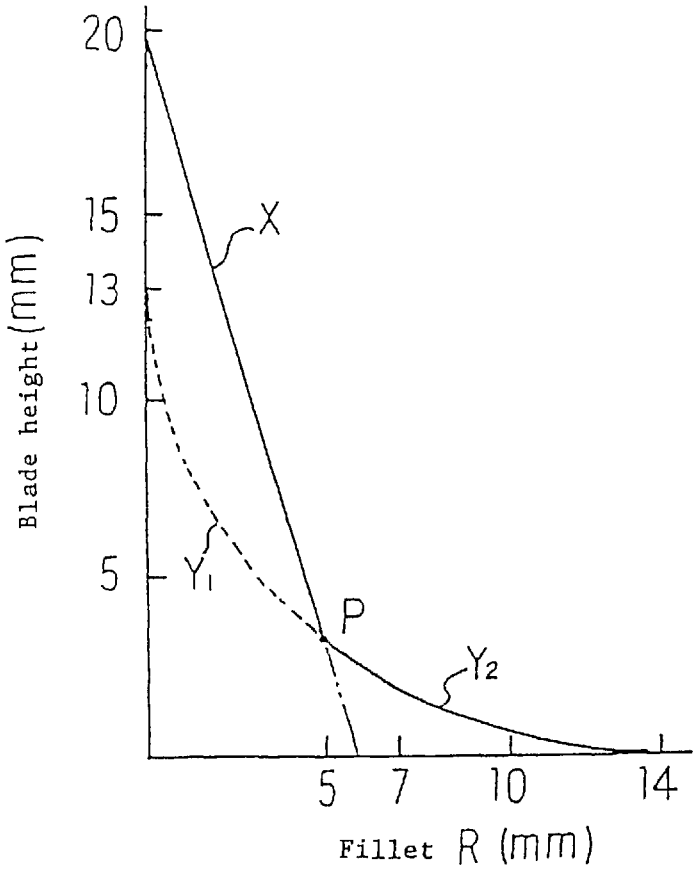

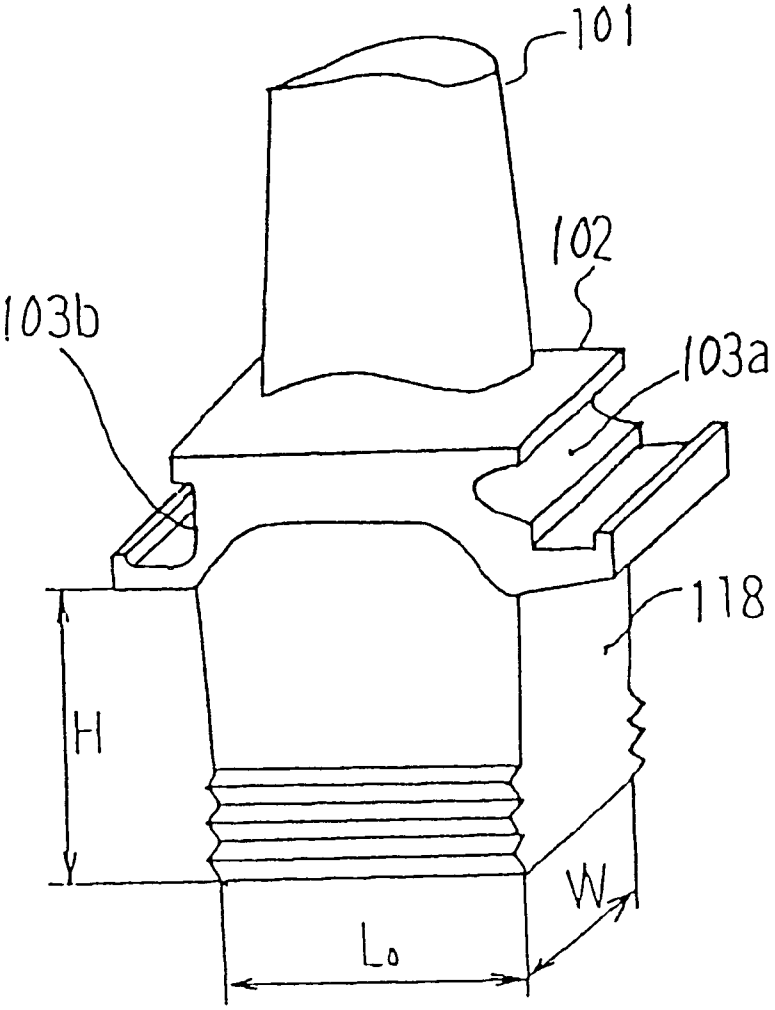
Fig. 12 (b)
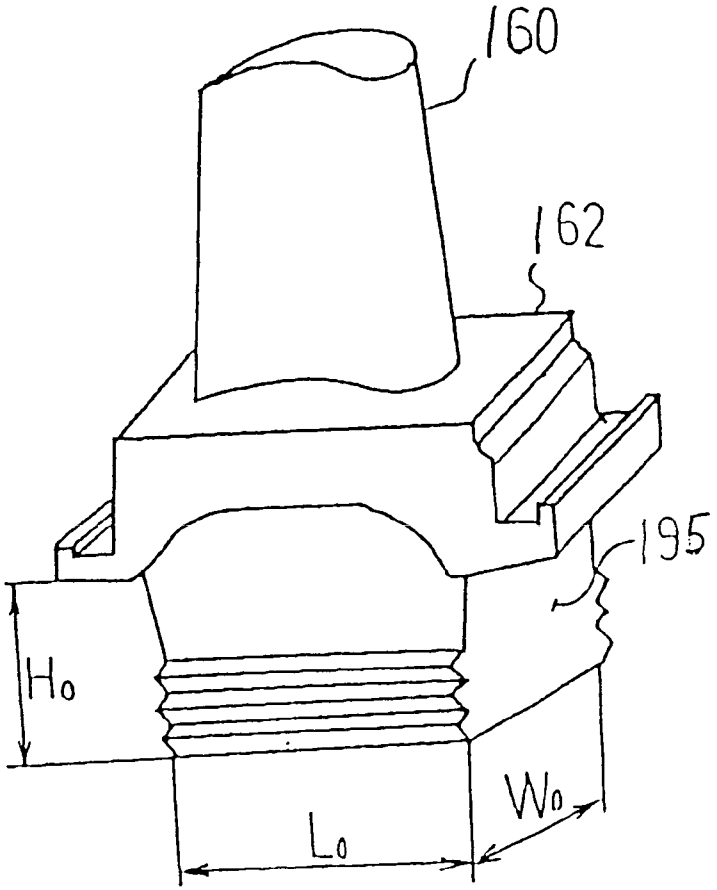
Fig. 12 (a) PRIOR ART

Fig. 16 (a) (Prior Art)
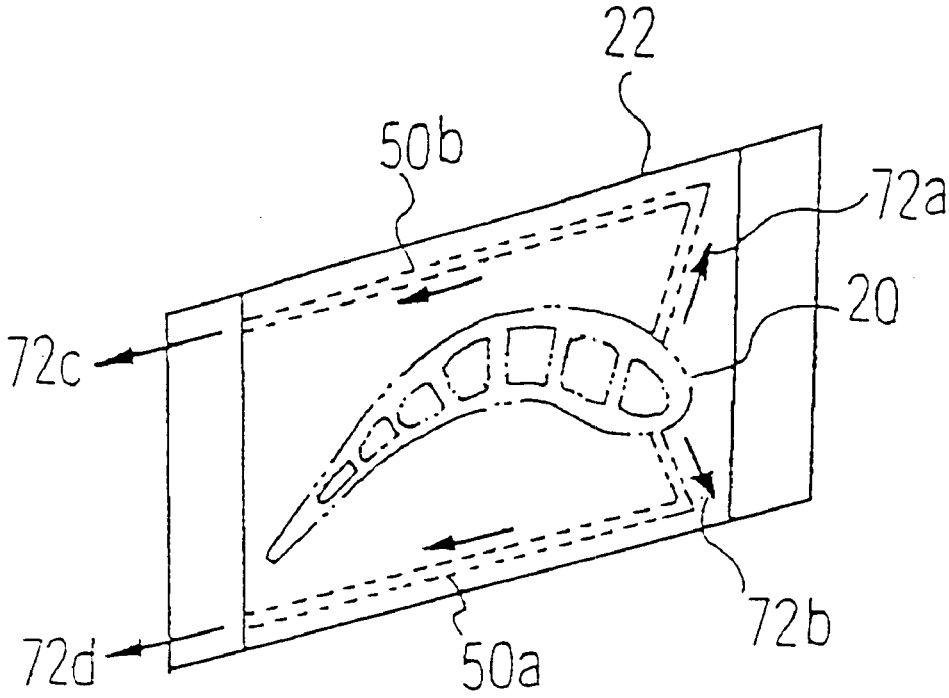
Fig. 16 (b) (Prior Art)
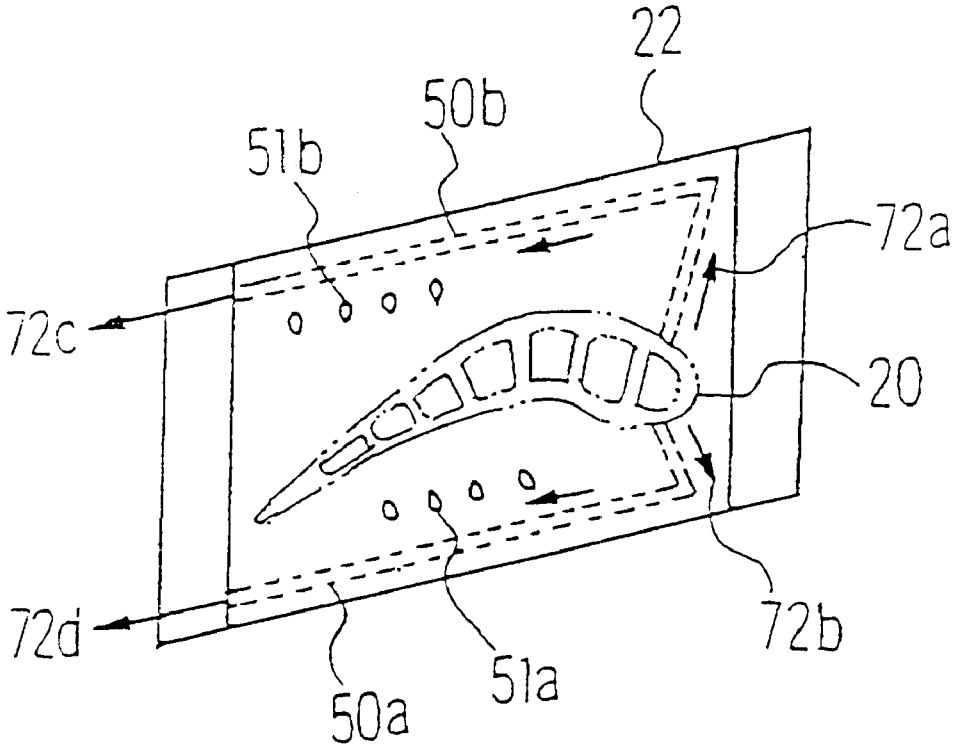

Fig. 17 (a) (Prior Art)
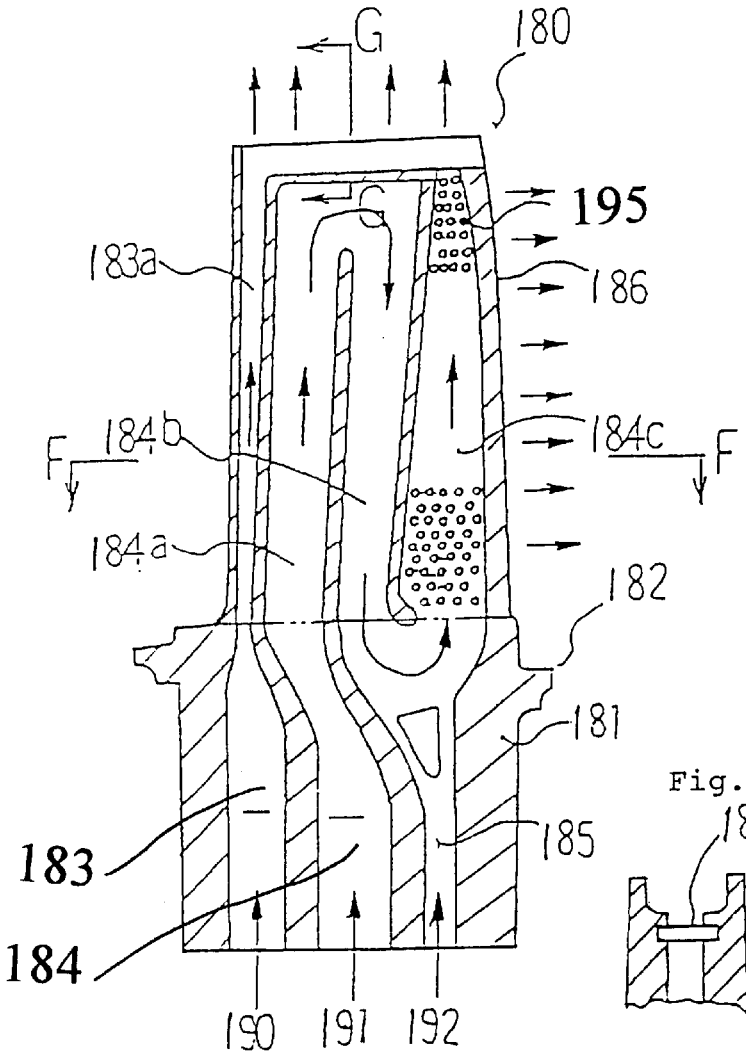
Fig. 17 (c) (Prior Art)
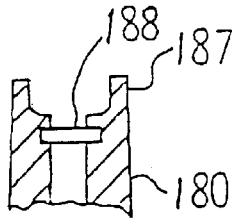
Fig. 17 (b) (Prior Art)
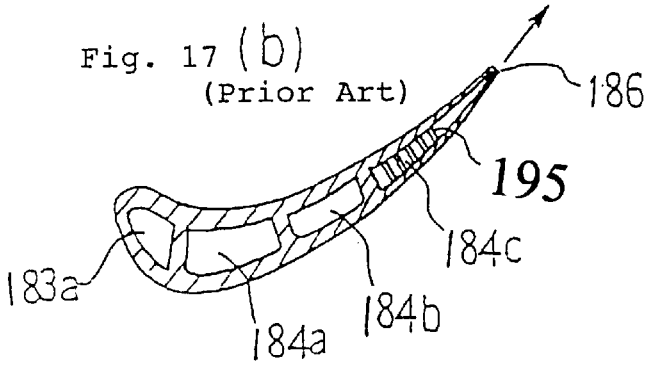

GAS TURBINE MOVING BLADE

BACKGROUND OF THE INVENTION

1. Field of the Invention

The present invention relates generally to a gas turbine moving blade and more particularly to a gas turbine moving blade which is improved with regard to its blade and platform cooling structure so as to prevent occurrence of cracks due to thermal stresses caused by temperature changes during gas turbine starts and stops, or caused by high temperature combustion gas.

2. Description of the Prior Art

In FIG. 14, which is a cross sectional view of a representative first stage moving blade of a prior art gas turbine, numeral 20 designates the moving blade, numeral 21 designates a blade root portion and numeral 22 designates a platform. In the blade root portion 21, there are provided cooling passages 23, 24, 25, 26, which are independent of each other. The cooling passage 23 is a passage on a blade leading edge side to communicate with a cooling passage 23*a* provided in a blade leading edge portion. Cooling air represented by arrow 40 flows into the cooling passage 23 from a turbine rotor side to flow through the cooling passage 23*a* and to flow out of a blade tip portion for cooling the blade leading edge portion and, at the same time, to flow out of cooling holes 29 for effecting a shower head film cooling of the blade leading edge portion. Cooling air represented by arrow 41 flows into the cooling passage 24 to flow through a cooling passage 24*a* provided in the blade, and then turns at the blade tip portion to flow through a cooling passage 24*b*, and turns again at a blade base portion to flow through a cooling passage 24*c*, and then flow out of the blade tip portion. In this process of the flow, the cooling air represented by arrow 41 cools a blade interior and, at the same time, flows out of cooling holes, to be described later with respect to FIG. 15, onto a blade surface for effecting a film cooling thereof.

Cooling air represented by arrow 42 entering the cooling passage 25, and cooling air represented by arrow 43 entering the cooling passage 26, join together to flow through a cooling passage 25*a*, then turn at the blade tip portion to flow through a cooling passage 25*b*, and turn again at the blade base portion to flow through a cooling passage 25*c*. In this process of the flow, the cooling air represented by arrows 42, 43 cools the blade interior and, at the same time, flows out of cooling holes, to be described later with respect to FIG. 15, onto the blade surface for effecting the film cooling thereof. A remaining portion of the cooling air represented by arrows 42, 43 flows out of cooling holes 28 of a blade trailing edge 27 for effecting a pin fin cooling of a blade trailing edge portion.

In FIG. 15, which is a cross sectional view taken on line B—B of FIG. 14, a portion of the cooling air flowing through the cooling passage 23*a* in the blade leading edge portion flows out of the blade through the cooling holes 29 for effecting the shower head film cooling of the blade leading edge portion. Also, a portion of the cooling air flowing through the cooling passage 24*c* flows outside obliquely through cooling holes 30 for effecting the film cooling of the blade surface. Likewise, a portion of the cooling air flowing through the cooling passage 25*c* flows outside obliquely through cooling holes 31 for effecting the film cooling of the blade trailing edge portion. It is to be noted that although the cooling holes 29, 30, 31 only are illustrated, there are actually provided a multiplicity of cooling holes other than the mentioned three kinds of the cooling holes 29, 30, 31.

In FIGS. 16(*a*) and 16(*b*), which are explanatory plan views of a cooling structure of the platform 22, FIG. 16(*a*) shows an example to cool a front portion, or a blade leading edge side portion, of the platform 22 as well as to cool both side portions, or blade ventral and dorsal side portions, of the platform 22. And FIG. 16(*b*) shows another example to cool upper surface portions of both of the side portions of the platform 22 in addition to the cooled portions of FIG. 16(*a*). In FIG. 16(*a*), there are bored cooling passages 50*a*, 50*b* in the front portion and both of the side end portions of the platform 22 so as to communicate with the cooling passage 23 of the leading edge portion of the moving blade 20. Cooling air represented by arrows 72*a*, 72*b* flows through the cooling passages 50*b*, 50*a*, respectively, for cooling the front portion and both of the side portions of the platform 22, and flows out through a rear portion, or a blade trailing edge side portion, of the platform 22 as air represented by arrows 72*c*, 72*d*.

In FIG. 16(*b*), in addition to the cooling passages 50*a*, 50*b* of FIG. 16(*a*), there are provided a plurality of cooling holes 51*a*, 51*b*, respectively, in both of the side portions of the platform 22 so as to open at an upper surface of the platform 22. These cooling holes 51*a*, 51*b* communicate with one or more of the cooling passages leading to the interior of the moving blade 20, so that cooling air flows through the cooling holes 51*a*, 51*b* to flow out onto the upper surface of the platform 22 and cool both of the side portions of the platform 22. Thus, in the gas turbine moving blade, the moving blade 20 as well as the platform 22 are cooled as described with respect to FIGS. 14 to 16(*b*), so that thermal influences resulting from high temperature combustion gas are mitigated.

In FIGS. 17(*a*)–17(*c*), which show an example of a second stage moving blade in the prior art, FIG. 17(*a*) is a cross sectional view thereof, FIG. 17(*b*) is a cross sectional view taken on line F—F of FIG. 17(*a*) and FIG. 17(*c*) is a cross sectional view taken on line G—G of FIG. 17(*a*). In FIGS. 17(*a*) and (*b*), numeral 180 designates the second stage moving blade, numeral 181 designates a blade root portion and numeral 182 designates a platform. In the blade root portion 181, there are provided cooling passages 183, 184, 185, which are independent of each other. The cooling passage 183 is a passage on a blade leading edge side to communicate with a cooling passage 183*a* provided in a blade leading edge portion. Cooling air represented by arrow 190 flows into the cooling passage 183 from a turbine rotor side to flow through the cooling passage 183*a* for cooling the blade leading edge portion and to flow outside through a blade tip portion. Cooling air represented by arrow 191 flows into the cooling passage 184 to flow through a cooling passage 184*a* provided in the blade, then turns at the blade tip portion to flow through a cooling passage 184*b*, and turns again inwardly toward a blade base portion. In the blade base portion, the cooling air represented by arrow 191, and cooling air represented by arrow 192 flowing through the cooling passage 185, join together and flow into a cooling passage 184*c*. In the cooling passage 184*c*, the cooling air represented by arrows 191, 192 flows between pin fms 195 for enhancing the cooling effect, and flows outside through slots 186 provided in a blade trailing edge as well as through a hole of the blade tip portion. In this process of the cooling air flow, the blade is cooled.

In FIG. 17(*c*), there is provided a blade tip thinned portion 187 along each of blade tip edge portions of the moving blade 180 so as to function as a seal of air leaking toward blade rear stages from the blade tip. Numeral 188 designates a plug, which plugs up openings provided for working purposes when the moving blade 180 is being manufactured. In the second stage moving blade 180 as so constructed, the cooling air is led into the interior of the blade, so that thermal influences resulting from high temperature combustion gas are mitigated.

As mentioned above, in the gas turbine moving blade, the blade and the platform are cooled by flowing the cooling air, and elevation of metal temperature due to the high temperature combustion gas is suppressed. While there is a large difference in mass between the platform and a blade profile portion of the gas turbine moving blade, the platform and the blade profile portion are cooled by the cooling air during a gas turbine steady operation time, and there occurs no large temperature difference between the platform and the blade profile portion, so that thermal stress influences caused by the temperature difference are also small. However, during an unsteady time during stoppage of the gas turbine, while the blade profile portion, which is of a thin shape, has been previously cooled, the platform, which is of a larger mass, is cooled slowly, and this causes a large temperature difference between the the platform and the blade profile portion, which results in large thermal stresses.

If large thermal stresses occur between the blade profile portion and the platform, as mentioned above, cracks may arise easily, especially at a portion where there is the severest thermal influence; that is, at blade hub portions where the blade and the platform join together at the blade leading edge and trailing edge sides. Also, cracks are likely to arise at other portions where there are thermal stress influences; that is, at the cooling holes of the blade trailing edge, the blade tip thinned portion and the like.

The cracks of the mentioned portions are caused by a combination of creep ruptures caused by high temperature and high stress repeated because of long time operations, and fatigue failures caused by repeated stresses due to operation starts and stops. In order to avoid such cracks, it is necessary to reduce the temperature and thermal stresses as much as possible at portions where stress concentrations are caused (i.e. blade and platform fitting portions at the blade leading edge and trailing edge portions).

SUMMARY OF THE INVENTION

In view of the problems in the prior art, therefore, it is an object of the present invention to provide a gas turbine moving blade which is improved with regard to structural portions of the blade and platform, which are prone to be influenced by thermal stresses, especially blade and platform fitting portions and blade trailing edge cooling holes. It is another object to provide a gas turbine moving blade which is improved with regard to cooling structures of a blade tip portion, and platform front and rear end portions, so that cracks caused by thermal stresses due to temperature differences may be suppressed and life and reliability of the blade may be enhanced.

In order to achieve the mentioned objects, the present invention provides the following (1) to (11):

(1) A gas turbine moving blade comprising a platform and a blade fitting portion where a blade is fitted to the platform, A blade cooling passage is provided in the blade, a platform cooling passage is provided in the platform, and cooling air blow holes are provided in and around the blade so that the blade may be cooled by cooling air flowing through the blade cooling passage, flowing through the platform cooling passage, and flowing out of the blade through the cooling air blow holes. Also provided is a recessed portion, having a smooth curved surface and extending in a direction orthogonal to a turbine axial direction. The recessed portion is in an end face portion of a rear side portion of the platform near the blade fitting portion on a blade trailing edge side. The blade fitting portion is formed with a fillet exterior having a curved surface. The cooling air blow holes are provided in a blade trailing edge and include a hole provided in a blade hub portion positioned at a lowermost end of the cooling air blow holes. This hole in the blade hub portion has a hole cross sectional area larger than that of each of the other cooling air blow holes provided above the hole in the blade hub portion.

(2) A gas turbine moving blade as mentioned in (1) above, characterized in that there is applied a coating of a heat resistant material to the blade and platform so that the blade fitting portions of the blade leading edge and trailing edge portions are provided with a coating that is thicker than the coating on other portions of the blade, and portions of the platform near and around the blade leading edge and trailing edge portions are provided with a coating that is thinner than the coating on other portions of the platform.

(3) A gas turbine moving blade as mentioned in (1) above, characterized in that the curved surface of the fillet exterior defines an elliptical curve.

(4) A gas turbine moving blade as mentioned in (1) above, characterized in that the platform cooling passage is connected with a platform cooling air supply system, and there are provided in the platform cooling air supply system an opening/closing valve for opening and closing the platform cooling air supply system. Also, provided is a control unit for controlling the opening/closing valve so as to be closed while a gas turbine is being operated and to be opened for a predetermined time when the gas turbine is being stopped.

(5) A gas turbine moving blade as mentioned in (1) above, further comprising a shank portion for fixing the platform. The shank portion has an elongated shape having a height (H) in the turbine radial direction which is larger than a width (W) of the shank portion in a turbine rotational direction (H>W).

(6) A gas turbine moving blade comprising a platform and a blade fitting portion where a blade is fitted to the platform. A blade serpentine cooling passage is provided in the blade, a platform cooling passage is provided in each of blade ventral and dorsal side end portions of the platform, and cooling air blow holes are provided in and around the blade so that the blade may be cooled by cooling air flowing through the blade serpentine cooling passage, flowing through the platform cooling passage, and flowing out of the blade through the cooling air blow holes. The blade serpentine cooling passage comprises two flow paths constructed such that cooling air entering a central portion of a blade root portion flows toward the blade leading edge and trailing edge sides. The blade fitting portion has an exterior with a curved surface. There is provided a recessed portion, extending in a direction orthogonal to a turbine axial direction, in an end face portion of each of front side and rear side portions of the platform near the blade fitting portions on the blade leading edge and trailing edge sides. The cooling air blow holes include a plurality of cooling holes provided in the platform, with the cooling holes being arranged along the platform cooling passage on the blade dorsal side, and each having one end communicating with the platform cooling passage on the blade dorsal side and another end opening at an end face on the blade dorsal side of the platform.

(7) A gas turbine moving blade as mentioned in (6) above, characterized in that the curved surface of the exterior of each of the blade fitting portions on the blade leading edge and trailing edge sides comprises a combination of a linear portion and a curved portion.

(8) A gas turbine moving blade as mentioned in (6) above, further comprising a blade tip thinned portion provided only at a blade tip edge portion on the blade dorsal side, and a plug of a circular shape provided in a blade tip portion.

(9) A gas turbine moving blade as mentioned in any one of (6) to (8) above, further comprising a shank portion for fixing the platform. The shank portion has an elongated shape having a height (H) in the turbine radial direction which is larger than a width (W) of the shank portion in a turbine rotational direction (H>W).

(10) A gas turbine moving blade comprising a platform and a blade fitting portion where a blade is fitted to the platform. A blade serpentine cooling passage is provided in the blade, a platform cooling passage is provided in each of blade ventral and dorsal side end portions of the platform, and cooling air blow holes are provided in and around the blade so that the blade may be cooled by cooling air flowing through the blade serpentine cooling passage, flowing through the platform cooling passage and flowing out of the blade through the cooling air blow holes. The blade serpentine cooling passage comprises a flow path constructed such that cooling air entering a central portion of a blade root portion flows toward a blade trailing edge side. The blade fitting portion has an exterior with a curved surface. There is provided a recessed portion, extending in a direction orthogonal to a turbine axial direction, in an end face portion of a rear side portion of the platform near the blade fitting portion on the blade trailing edge side. The cooling air blow holes include a plurality of cooling holes provided in the platform. The cooling holes are arranged along the platform cooling passage on the blade dorsal side, and each hole has one end communicating with the platform cooling passage on the blade dorsal side and another end opening at an end face on the blade dorsal side of the platform.

(11) A gas turbine moving blade as mentioned in (10) above, further comprising a blade tip thinned portion provided only at a blade tip edge portion on the blade dorsal side.

In the invention as described in (1), because there is provided the recessed portion, or cut-out portion, having the smooth curved surface, in the rear end face portion of the platform near the blade fitting portion on the blade trailing edge side, a thick portion of the platform near this blade fitting portion is thinned by the recessed portion. Thus, there is eliminated a sharp thickness change between the thin blade portion and the thick platform portion, and also the mass of the platform right under the thin blade portion is reduced by the recessed portion to make the thermal capacity thereat smaller, and thus the thermal capacity difference also can be made smaller. Accordingly, the temperature difference caused by the difference in the cooling velocity during gas turbine stoppage or the like also becomes smaller, and occurrence of cracks as have been caused by the thermal stresses at the blade fitting portion can be prevented. Further, because the fillet of the blade fitting portion has a curved surface which has partially the linear portion, the fillet R is larger than that of the conventional case with regard to curvature and the rigidity of this portion is strengthened. Moreover, because the lowermost hole of the cooling air blow holes provided in the blade trailing edge has a cross sectional area larger than that of the other cooling air blow holes, the cooling effect of this portion is enhanced and the temperature difference in the blade fitting portion becomes smaller to suppress occurrence of thermal stresses, and thus cracks can be avoided.

In the invention as described in (2), because the thermal barrier coating (TBC) of the heat resistant material is applied to the blade, so that temperature lowering of the blade after stoppage of the gas turbine becomes slower, the temperature difference between the blade fitting portion and the platform becomes smaller and thus the thermal stresses are made smaller. Also, temperature lowering of the blade portion where the thicker TBC is applied becomes further slower, and the temperature difference between the blade and the platform becomes further smaller. Moreover, because of the platform portion where the thinner TBC is applied, temperature lowering of the platform at and around this portion is comparatively fast, so that the temperature difference between the blade fitting portion and the platform becomes further smaller and thus thermal stresses caused thereat are made further smaller. Also, in the invention as described in (3), because the fillet exterior of the blade fitting portion is elliptically curved, the curvature of the fillet exterior becomes large and the stress concentration in this portion can be mitigated.

In the invention as described in (4), when the gas turbine is stopped, the control unit opens the opening/closing valve for the predetermined time so that cooling air from the platform cooling air supply system may be led actively into the cooling passage of the platform, and the platform is cooled even during stoppage of the gas turbine. Hence, cooling of the platform, which is slower in temperature lowering than is the thin moving blade, is accelerated. Also, the temperature difference between the blade and the platform is made smaller to suppress occurrence of thermal stresses, and thus occurrence of cracks is prevented.

In the invention as described in (5), because the shank portion which fixes the platform is elongated in its height direction as compared with the conventional shank portion, deformation caused by thermal stresses at the connection portion of the blade and the platform is absorbed by a damping effect which results from the elongation of the shank portion, thereby mitigating the influences of thermal stresses whereby occurrence of cracks is prevented.

In the invention as described in (6), pertaining to a first stage moving blade, because there are two flow paths of the serpentine cooling passage in which the cooling air flows toward the blade leading edge side and toward the blade trailing edge side, the blade interior is cooled effectively. At the same time, because the recessed portions or cut-out portions are provided in the platform front and rear end faces near the blade fitting portions on the blade leading edge and trailing edge sides, the thick portions right under the mentioned blade fitting portions are thinned by the recessed portions. Thus, there is eliminated a sharp thickness change between the thin blade and the thick platform, and also mass of the platform in the mentioned portions is reduced to lower the thermal capacity thereat and to thereby make the thermal capacity difference smaller. Accordingly, the temperature difference caused by the difference in the cooling velocity between the blade and platform becomes smaller, and occurrence of cracks due to thermal stresses as have been caused at the connection portion of the blade and the platform is prevented. Moreover, because the platform is cooled by the cooling air flowing through the cooling passages of both side end portions, or the blade ventral and dorsal side end portions, of the platform, as well as the cooling air flowing out of the platform side end face through the cooling holes provided along the cooling passage on the blade dorsal side end portion of the platform, the blade dorsal side end portion of the platform which is exposed to high temperature combustion gas, and thus prone to be in a thermally severe state, is cooled effectively.

In the invention as described in (7), because the exterior of the two fillets on the blade leading edge and trailing edge sides has a curved surface having the combination of the linear portion and the curved portion, for example, with the linear portion being on the upper side of the fillet and the curved portion being on the lower side near the blade fitting portion, the mentioned curved surface approaches a linear surface such that the curvature of the fillet is larger than that of the fillets on the blade ventral and dorsal sides, and thereby rigidity of this portion is enhanced, occurrence of thermal stresses is suppressed, and occurrence of cracks is prevented.

In the invention as described in (8), because the blade tip thinned portion on the blade ventral side tip edge portion is eliminated as compared with the conventional case, and the blade tip thinned portion is only provided on the blade dorsal side tip edge portion, which receives especially high thermal influences, the blade tip sealing performance is at least maintained by the blade tip thinned portion on the blade dorsal side tip edge portion, such that damage of the blade tip thinned portion due to high temperature can be lessened. Also, because the plug is of a circular shape, fitting of the plug becomes facilitated and damage thereof due to high temperature is lessened.

In the invention as described in (9), because the shank portion which fixes the platform is elongated in its height direction as compared with the conventional shank portion, deformation caused by thermal stresses at the connection portion of the blade and the platform is absorbed by the damping effect which results from the elongation of the shank portion, thereby mitigating the influences of thermal stresses whereby occurrence of cracks is prevented.

In the invention as described in (10), pertaining to a second stage moving blade, because the serpentine cooling passage comprises the flow path in which the cooling air entering the central portion flows toward the blade trailing edge side, the blade interior is cooled effectively. At the same time, because the recessed portion or cut-out portion is provided in the platform rear end face near the blade fitting portion on the blade trailing edge side, the thick portion right under the mentioned blade fitting portion is thinned by the recessed portion. Thus, there is eliminated a sharp thickness change between the thin blade and the thick platform, and also mass of the platform in the mentioned portion is reduced to lower the thermal capacity thereat and to thereby make the thermal capacity difference smaller. Accordingly, the temperature difference caused by the difference in the cooling velocity between the blade and the platform becomes smaller, and occurrence of cracks due to thermal stresses as have been caused at the connection portion of the blade and the platform is prevented. Moreover, because the platform is cooled by the cooling air flowing through the cooling passages of both side end portions, or the blade ventral and dorsal side end portions, of the platform, as well as the cooling air flowing out of the platform side end face through the cooling holes provided along the cooling passage on the blade dorsal side end portion of the platform, the blade dorsal side end portion of the platform which is exposed to high temperature combustion gas, and thus prone to be in a thermally severe state, is cooled effectively.

In the invention as described in (11), because the blade tip thinned portion on the blade ventral side tip edge portion is eliminated as compared with the conventional case, and the blade tip thinned portion is only provided on the blade dorsal side tip edge portion, which receives especially high thermal influences, the blade tip sealing performance is at least maintained by the blade tip thinned portion on the blade dorsal side tip edge portion such that damage of the blade tip thinned portion due to high temperature can be lessened.

BRIEF DESCRIPTION OF THE DRAWINGS

FIGS. 4(*a*) and 4(*b*) are perspective views of a gas turbine moving blade including a shank portion thereof, wherein FIG. 4(*a*) shows prior art and FIG. 4(*b*) shows a second embodiment according to the present invention.

FIGS. 10(*a*)–10(*d*) show structures of a blade tip thinned portion, wherein FIG. 10(*a*) is a cross sectional view of prior art, FIG. 10(*b*) is a plan view of the prior art of FIG. 10(*a*), FIG. 10(*c*) is a cross sectional view taken on line C—C of the blade tip thinned portion of the fourth embodiment of FIG. 7 and FIG. 10(*d*) is a plan view of the blade tip thinned portion of FIG. 10(*c*).

FIG. 11 is a view showing a shape of a fillet of the fourth embodiment of FIG. 7 in comparison with a conventional fillet.

FIGS. 12(*a*) and 12(*b*) are perspective views of a gas turbine moving blade including a shank portion thereof, wherein FIG. 12(*a*) shows prior art and FIG. 12(*b*) shows a fifth embodiment according to the present invention.

FIGS. 16(*a*) and 16(*b*) are explanatory plan views of a cooling structure for a platform of the prior art moving blade of FIG. 14, wherein FIG. 16(*a*) shows an example to cool a front portion and both side portions of the platform and FIG. 16(*b*) shows an example to cool upper face portions of the platform in addition to the cooled portions of FIG. 16(*a*).

FIGS. 17(*a*)–17(*c*) show examples of a second stage moving blade of a prior art gas turbine, wherein FIG. 17(*a*) is a cross sectional view thereof, FIG. 17(*b*) is a cross sectional view taken on line F—F of FIG. 17(*a*) and FIG. 17(*c*) is a cross sectional view taken on line G—G of FIG. 17(*a*).

DESCRIPTION OF THE PREFERRED EMBODIMENTS

Herebelow, embodiments according to the present invention will be described concretely with reference to the figures.

Figure 1:
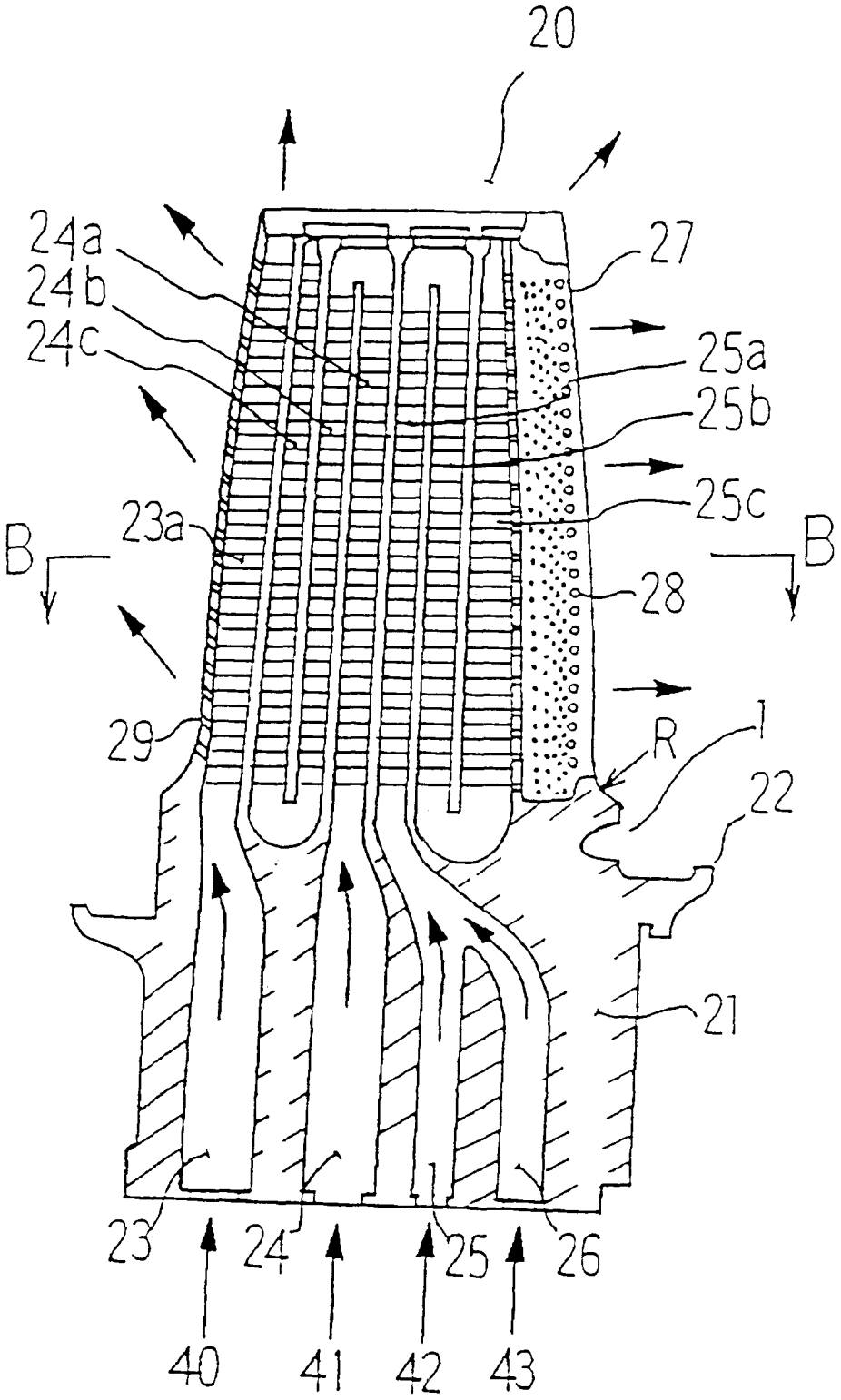
FIG. 1 is a cross sectional view of a gas turbine moving blade of a first embodiment according to the present invention.

In FIG. 1, which is a cross sectional view of a gas turbine moving blade of a first embodiment according to the present invention, there is provided a recessed groove or cut-out portion 1, which is grooved in or cut out of a thick portion and has a rounded smooth curved surface, at a blade fitting portion where a moving blade 20 and a platform 22 join together to be fitted to each other on a blade trailing edge side. The recessed groove 1 is provided in an end face portion of a rear portion, or a blade trailing edge side portion, of the platform 22, extending in a direction orthogonal to a turbine rotor axial direction and having such a groove depth as not affecting lines of load force of the blade.

Figure 2A:
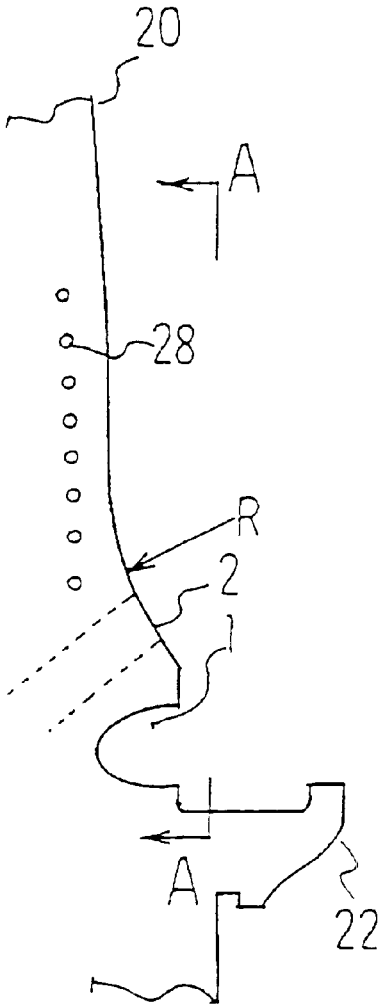
FIGS. 2(*a*)–2(*c*) show a blade fitting portion of the first embodiment of FIG. 1, wherein FIG. 2(*a*) is a side view of the blade fitting portion, FIG. 2(*b*) is a rear view seen from line A—A of FIG. 2(*a*) and FIG. 2(*c*) is a view showing a fillet of FIG. 2(*a*).
Figure 2B:
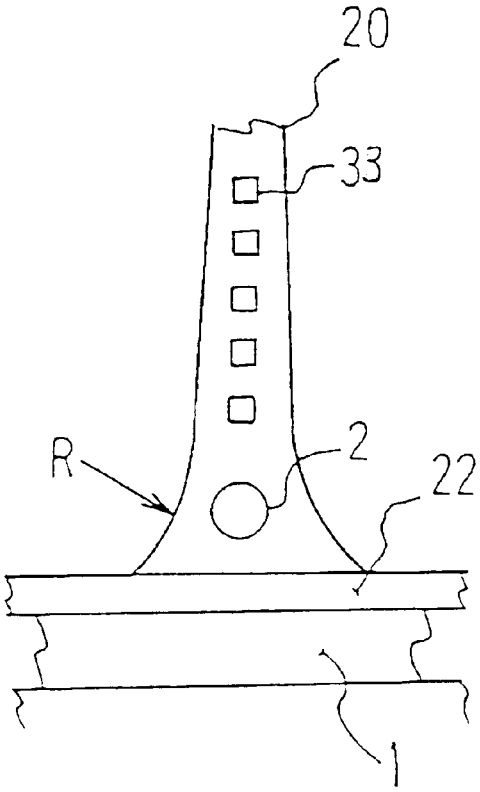
Figure 2C:
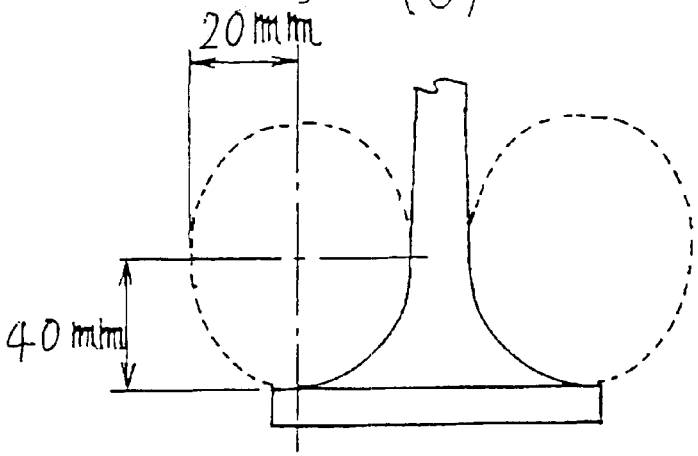

In FIGS. 2(*a*)–2(*c*) showing the blade fitting portion of the first embodiment of FIG. 1, FIG. 2(*a*) is a side view thereof, FIG. 2(*b*) is a rear view seen from line A—A of FIG. 2(*a*) and FIG. 2(*c*) is a view showing a fillet R of FIG. 2(*a*). As shown by the shape of the fillet R of FIG. 2(*c*) provided at the blade fitting portion on the blade trailing edge side, while fillets of portions other than the blade trailing edge side portion have a smaller curvature, 6 mm for example, in the present first embodiment, the fillet R is made to have an elliptical curve of 20 mm×40 mm. By so making the fillet R larger, the stress concentration can be suppressed.

Also, in FIGS. 2(*a*) and 2(*b*), while there are provided cooling holes 28 in a blade trailing edge portion and slots 33 in a blade trailing edge, one slot 2 nearest to the platform 22 (that is, the slot of the lowermost end, which is near a blade hub portion and is called a hub slot) is made to have a slot cross sectional area larger than that of other slots 33. For example, the hub slot 2 is of a 1.6 mm diameter while the other slots 33 are of a 1 mm diameter. Thus, the construction is made so as to enhance the cooling effect of this portion.

Figure 3:
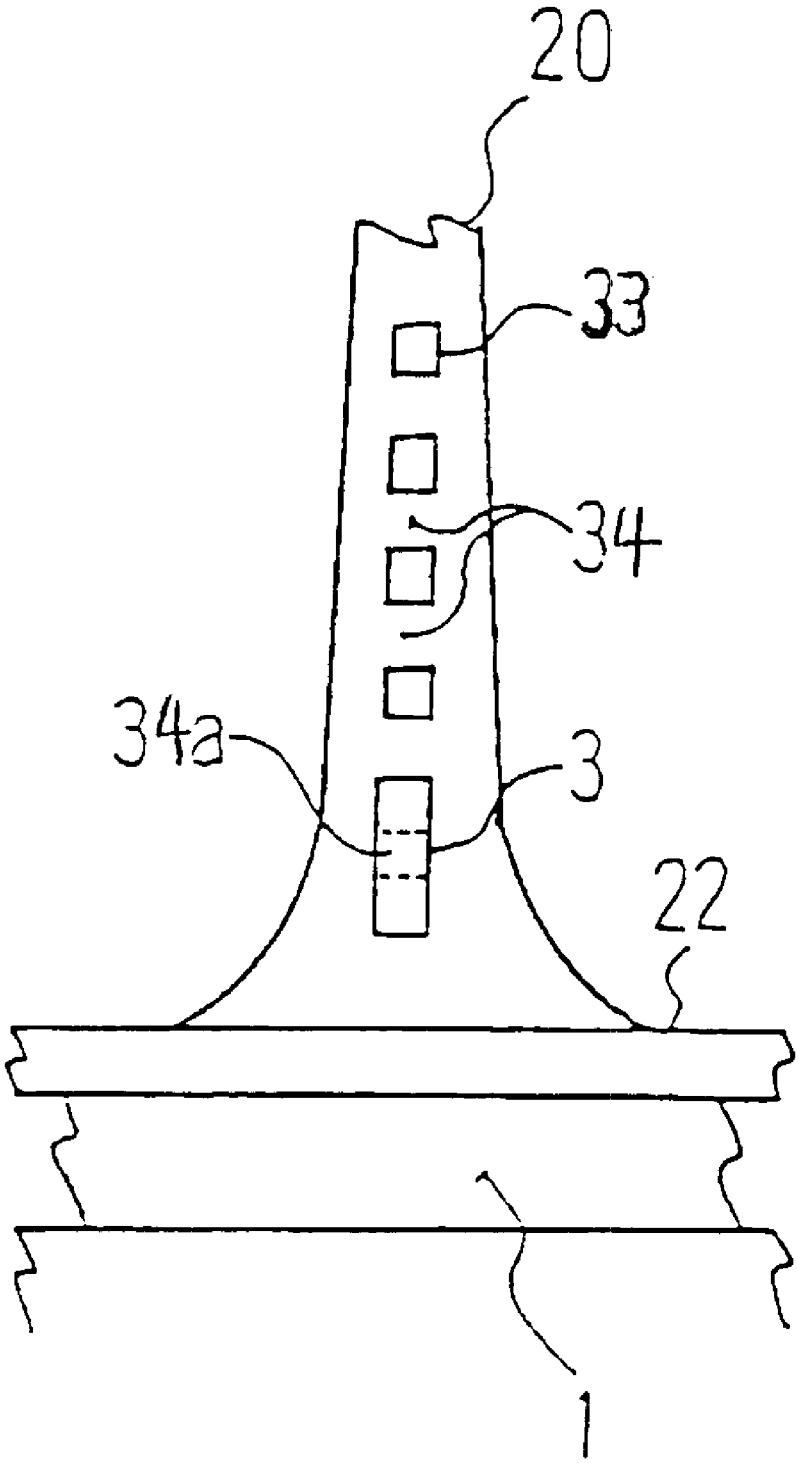
FIG. 3 is a rear view of a blade trailing edge showing a modified form of a hub slot of FIG. 2(*b*).

In FIG. 3, which is a rear view of the blade trailing edge showing a modified form of the hub slot of FIG. 2(*b*), while the slots 33 are formed by pedestals 34 provided between each of the slots 33, one pedestal 34*a* nearest to the platform 22 is cut off so as to connect two slots to each other to thereby form a hub slot 3. Thus, the hub slot 3 which is nearest to the platform 22 is made to have a slot cross sectional area larger than that of other slots 33. Other structures of the moving blade 20 and the platform 22 are same as those shown in FIGS. 1 and 2(*a*)–2(*c*) and description thereof will be omitted.

By the construction of the slots as described above, a heat transfer area in the slot portions of the blade fitting portion on the blade trailing edge side is increased, cooling air flowing therethrough is increased in volume, and temperature of the portion where the stress concentration occurs easily during operation can be reduced. Thus, the thermal stress influences in this portion are mitigated and occurrence of cracks can be prevented.

Further, in the moving blade 20 of the present embodiment, a TBC (thermal barrier coating) is applied to the entire surface of the moving blade 20 including the recessed groove 1 and the hub slot 2, 3. Moreover, in so applying the TBC, (1) the blade fitting portions at the platform 22 on the blade leading edge and trailing edge sides are provided with a thicker TBC as compared with other portions of the blade 20, and also (2) the platform 22 on the blade leading edge and trailing edge sides is provided with a thinner TBC as compared with other portions of the platform 22.

By the TBC so applied, when the gas turbine is stopped, cooling velocity of the blade is lowered as a whole, so that the temperature is lowered slowly, the temperature difference between the blade fitting portion and the platform becomes smaller, and the thermal stress caused in this portion is reduced. Also, according to (1) above, in the portions of the blade where the TBC is applied thicker, the temperature lowering becomes slower and the temperature difference between those portions of the blade and the platform becomes further smaller. Hence, the thermal stress caused in this portion is further reduced. Furthermore, according to (2) above, in portions other than the portion of the platform where the TBC is applied thinner, the temperature lowering becomes slower and the temperature difference between those portions of the platform becomes further smaller. Hence, the thermal stress caused in the platform is further reduced.

Figure 14:
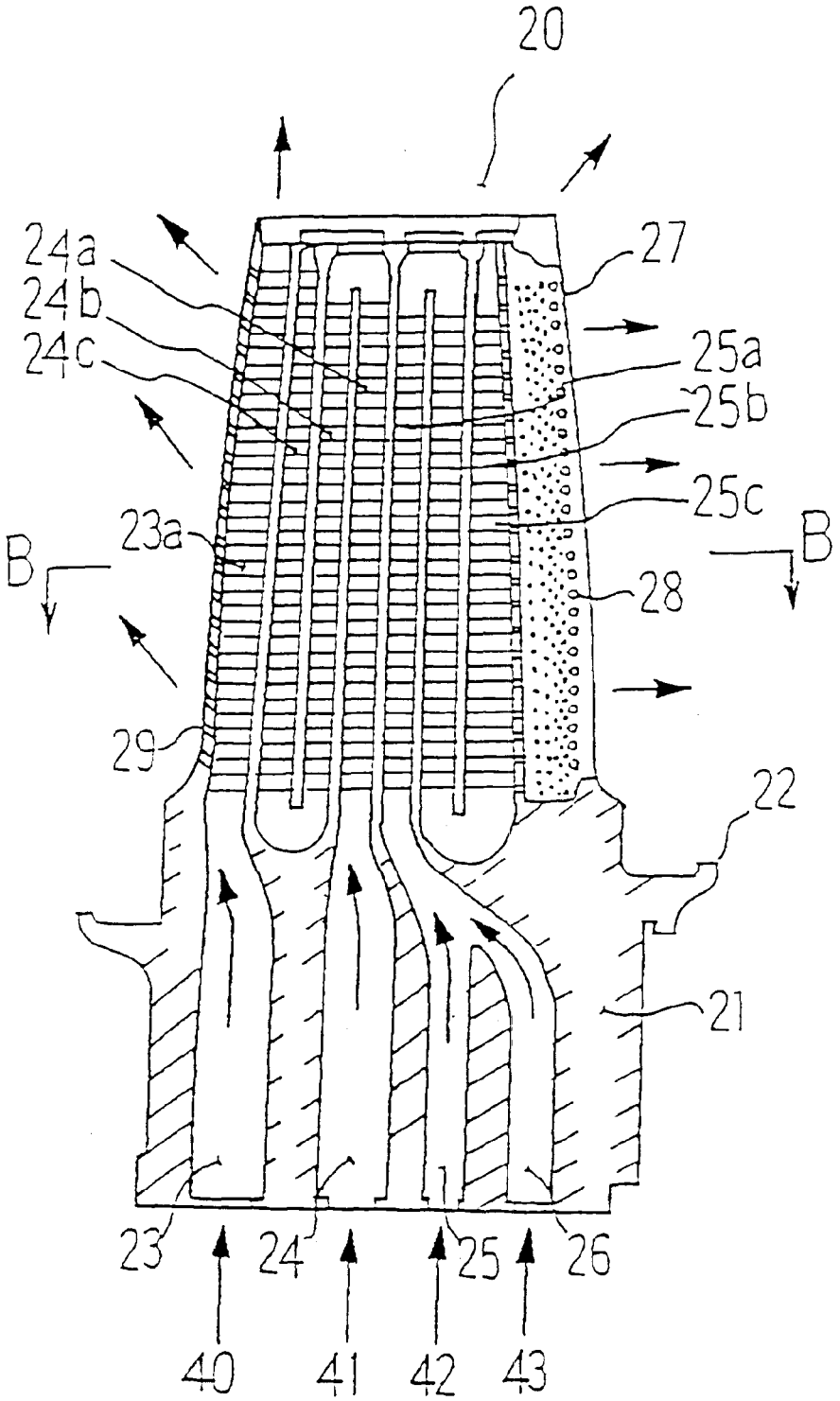
Fig. 14 (Prior Art)
FIG. 14 is a cross sectional view of a representative first stage moving blade of a prior art gas turbine.
Figure 15:
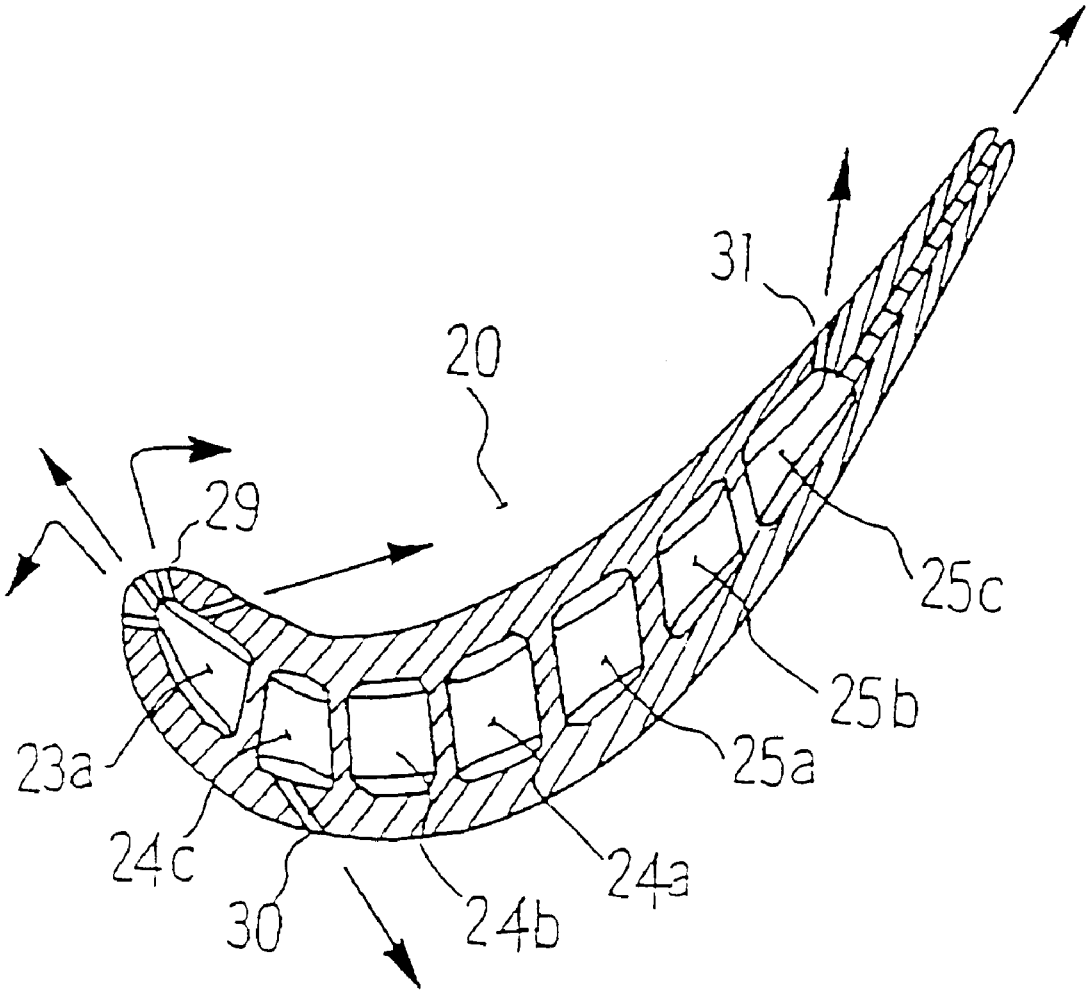
Fig. 15 (Prior Art)
FIG. 15 is a cross sectional view taken on line B—B of FIG. 14.

According to the gas turbine moving blade of the first embodiment as described above, cooling air flows in the same way as in the conventional case of FIGS. 14 to 16(*b*). That is, the cooling air represented by arrows 40 to 43 enters the interior of the moving blade 20 from inside of the platform 22, for cooling the moving blade 20, to then flow into the gas path through the blade tip portion on the blade leading edge side and through the cooling holes 29 to 31, and the blade trailing edge portion and, at the same time, enters the cooling passages 50*a*, 50*b* on both side end portions, or blade ventral and dorsal side end portions, of the platform 22, for cooling the platform 22, to then flow toward the rear portion, or the blade trailing edge side portion, of the platform 22. During this cooling process, as well as at the time of gas turbine stoppage, while, in the conventional case, the temperature difference between the blade profile portion and the platform 22 becomes large due to mass difference between the blade profile portion and the platform 22 to thereby cause thermal stresses, in the present invention, there is provided the recessed groove or the cut-out portion 1 in the rear portion, or the blade trailing edge side portion, of the platform 22 and thereby the following effect can be obtained.

That is, by the recessed groove 1, there is eliminated a sharp thickness change between a thin portion of the blade fitting portion of the moving blade 20 and a thick portion of the platform 22, and a thickness right under the thin portion of the blade fitting portion is recessed, so that thermal capacity thereat is reduced and thermal capacity difference therearound is also reduced. Thus, the cracks as have been so far caused by thermal stresses at the fitting portion of the moving blade 20 and the platform 22 can be prevented. Also, the fillet R at the blade fitting portion is made larger than in the conventional case so that rigidity at this curved surface portion is increased and occurrence of cracks at this portion can be suppressed.

Moreover, there is provided the hub slot 2, 3 at the portion of the fillet R, and the hub slot 2, 3 has a slot cross sectional area larger than that of the other slots 33. Hence, heat transfer area in the thickness changing portion of the blade fitting portion is increased, and also the cooling air is increased in volume so as to enhance the cooling effect.

Accordingly, in addition to the effect to reduce the thermal capacity by the recessed groove 1 right under the hub slot 2, 3, a large temperature difference therearound is suppressed synergically and occurrence of cracks can be prevented. Also, applied is the TBC, but it is applied thicker to the blade fitting portion and thinner to the platform 22 of that portion, so that, by this coating also, the thermal influences can be made smaller.

In FIGS. 4(*a*) and 4(*b*), which are perspective views of a gas turbine moving blade comprising a shank portion thereof, FIG. 4(*a*) shows prior art and FIG. 4(*b*) shows a second embodiment according to the present invention comprising the recessed groove of the first embodiment of FIG. 1 and an improvement in the shank portion. In the shank portion of the present second embodiment, the shank portion to fixedly support the platform 22 is elongated in the height direction and thinned in the width direction. That is, as compared with a conventional shank portion 40*a*, having a height $H_0$ and a width $W_0$, of a moving blade 20 shown in FIG. 4(*a*), a shank portion 40*b* shown in FIG. 4(*b*) has a height H and a width W, wherein H is larger than $H_0$ ($H>H_0$) and W is smaller than $W_0$ ($W<W_0$), and H is larger than W. By so making the shank portion 40*b* longer and thinner, the shank portion 40*b* is given a flexibility against thermal stress changes, and because of a damping effect thereof, the thermal stresses are dispersed and absorbed. Thereby, occurrence of cracks due to the thermal stresses can be suppressed.

Figure 5:
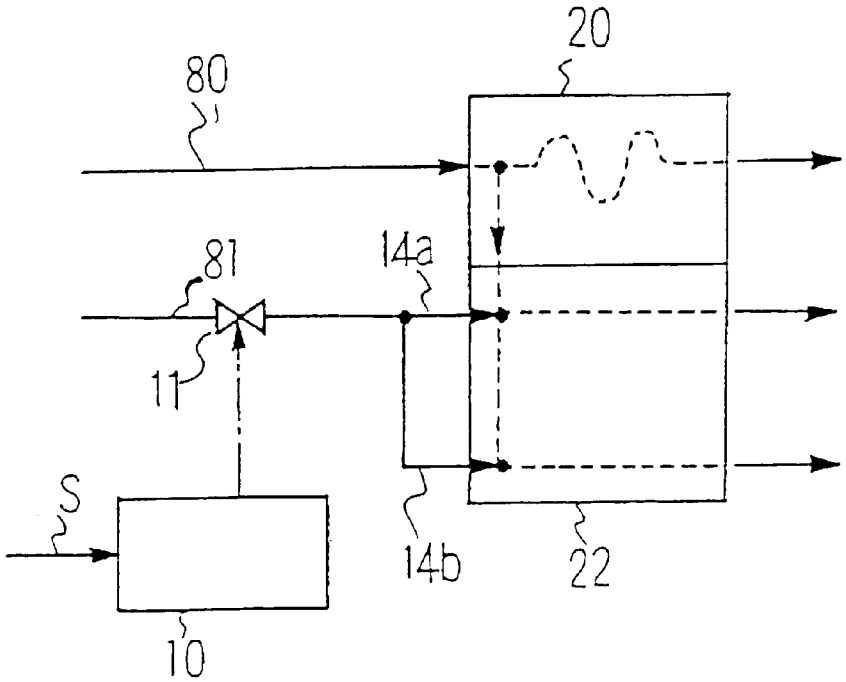
FIG. 5 is a cooling system diagram of a gas turbine moving blade of a third embodiment according to the present invention.

In FIG. 5, which is a cooling system diagram of a gas turbine moving blade of a third embodiment according to the present invention, cooling air is led into a moving blade 20 for cooling thereof from a cooling air supply system 80 and then flows out through a blade trailing edge portion and, at the same time, a portion of the cooling air is led into a platform 22 for cooling thereof and then flows out through a rear portion, or a blade trailing edge side portion, of the platform 22. This cooling system is the same as that of the conventional system described with respect to FIGS. 14 to 16(*b*).

In the present third embodiment, in addition to the cooling system mentioned above, there is provided a platform cooling air supply system 81, so that cooling air is led therefrom into cooling passages provided in the platform 22 via an opening/closing valve 11 and pipings 14*a*, 14*b*. Numeral 10 designates a control unit, and when the gas turbine is stopped, the control unit 10 is inputted with a gas turbine stop signal S to thereby control the opening/closing valve 11 so that cooling air may be supplied into the cooling passages of the platform 22 for a predetermined time after the stoppage of the gas turbine.

Figure 6:
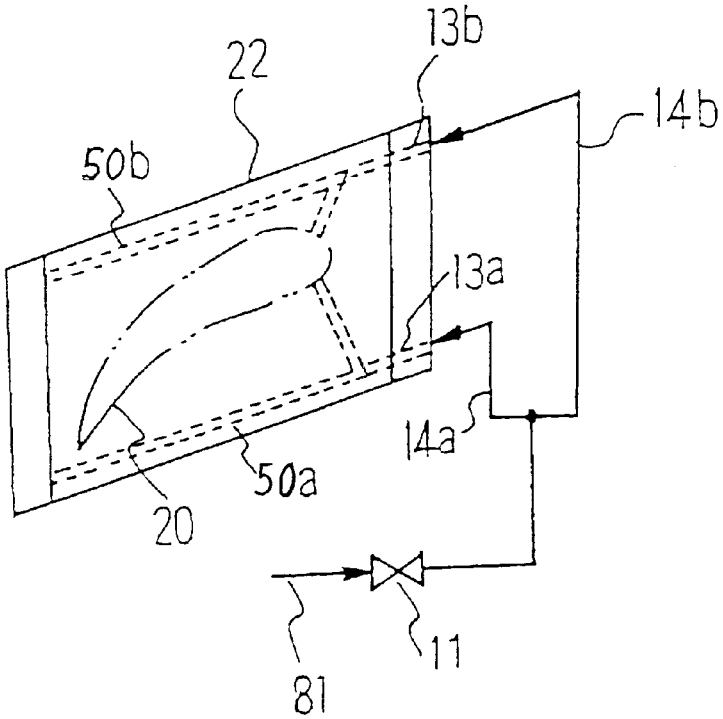
FIG. 6 is a plan view of a platform of the third embodiment according to the present invention, including a cooling system diagram thereof.

FIG. 6 is a plan view of the platform 22 of the third embodiment, including a cooling system diagram thereof. Like in the prior art case, there are provided the cooling passages 50*a*, 50*b* in a front portion, or a blade leading edge side portion as well as in both side end portions, or blade ventral and dorsal side end portions, of the platform 22 so that cooling air flows therein for cooling the front portion and both of the side portions of the platform 22 and flows out through a rear portion of the platform 22. Further, in the front portion of the platform 22, there are provided passages 13*a*, 13*b* so as to communicate with the cooling passages 50*a*, 50*b*, respectively, of both of the side end portions of the platform 22. On the other hand, the passages 13*a*, 13*b* are connected with the pipings 14*a*, 14*b*, respectively, and the pipings 14*a*, 14*b* are connected to the platform cooling air supply system via the opening/closing valve 11, as mentioned above.

In the cooling system of the third embodiment constructed as described above, the opening/closing valve 11 is closed during the ordinary operation time of the gas turbine so that the ordinary cooling, as mentioned above, may be carried out. When the gas turbine is stopped, the gas turbine stop signal S is inputted into the control unit 10 and the control unit 10 operates to open the opening/closing valve 11 for the predetermined time. Accordingly, cooling air from the platform cooling air supply system is led into the cooling passages 50*a*, 50*b* of the platform 22. That is, even after the stoppage of the gas turbine, the cooling air is supplied into the platform 22 so that the platform 22 only may be cooled actively for the predetermined time, and when the platform 22 is so cooled for the predetermined time, the opening/closing valve 11 is closed by the control unit 10.

In the conventional case, when the gas turbine is stopped, the platform 22, which has a mass larger than the moving blade 20, is slow to have the temperature thereof reduced, which causes a large temperature difference between the thin blade 20 and the thick platform 22, and this causes large thermal stresses. But in the cooling system of the present invention, the platform 22 is cooled actively even after the stoppage of the gas turbine to accelerate the temperature lowering of the platform 22, so that no large temperature difference occurs between the moving blade 20 and the platform 22, and thereby occurrence of the thermal stresses is prevented and occurrence of cracks can be suppressed.

It is to be noted that, while the cooling system of the mentioned third embodiment has been described where it is used with a gas turbine moving blade of the prior art, this cooling system may be naturally used with a gas turbine moving blade having constructions of the first and second embodiments, and then the effect to prevent the occurrence of cracks can be obtained further securely.

Figure 7:
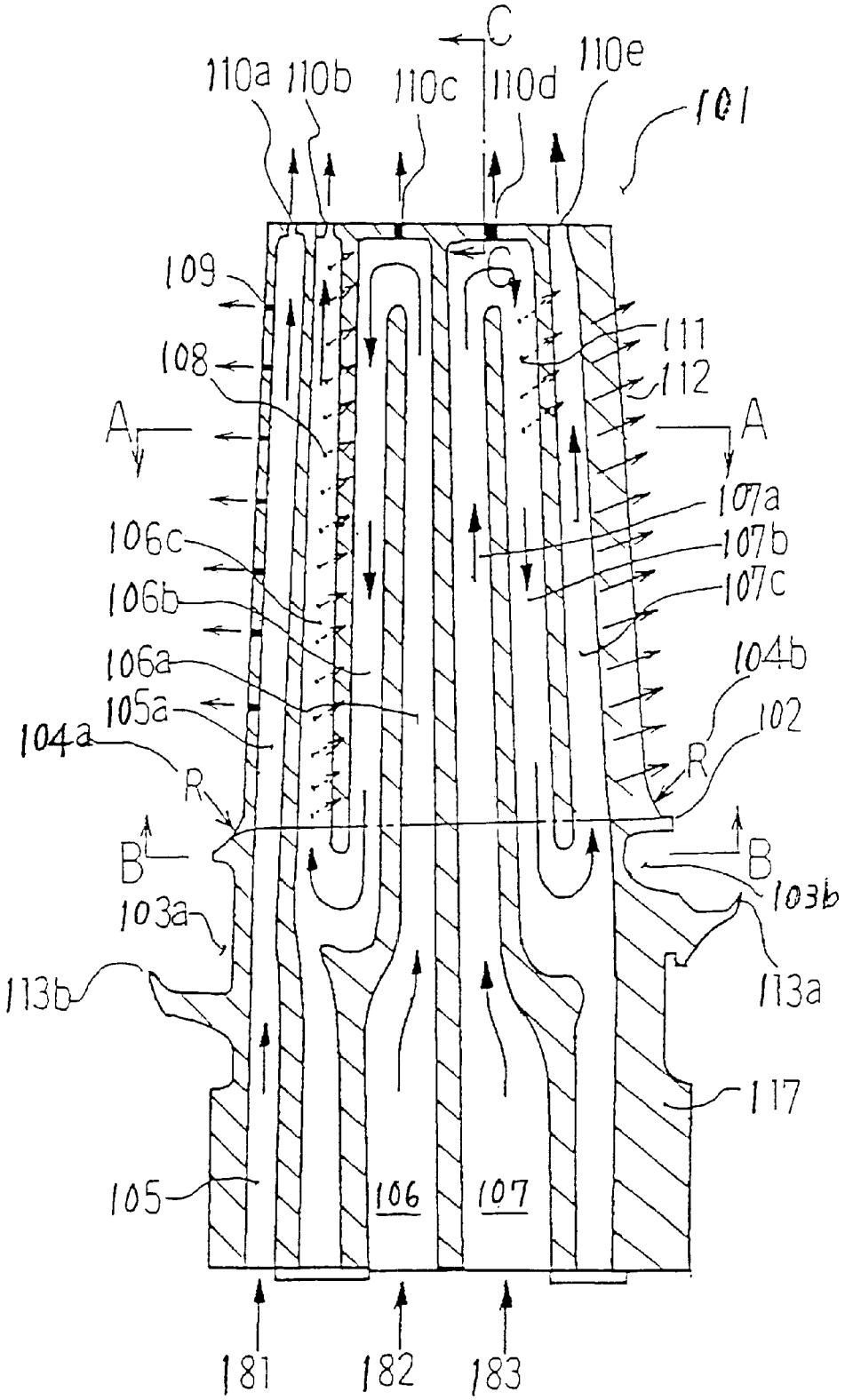
FIG. 7 is a cross sectional view of a gas turbine first stage moving blade of a fourth embodiment according to the present invention.

FIG. 7 is a cross sectional view of a gas turbine first stage moving blade of a fourth embodiment according to the present invention. In FIG. 7, numeral 101 designates the first stage moving blade and numeral 102 designates a platform. There are provided a cutout portion 103*a* formed in a recessed groove on a front portion, or a blade leading edge side portion, of the platform 102 and another cut-out portion 103*b* formed with a smooth curved surface on a rear portion, or a blade trailing edge side portion, of the platform 102. Numerals 104*a* and 104*b* designate fillets R provided on the blade leading edge and trailing edge sides, respectively. Both of the fillets R have a curvature larger than that of fillets on blade ventral and dorsal sides.

Numeral 117 designates a blade root portion. Within the blade root portion 117, there are provided cooling passages 105, 106, 107, which are independent of each other. The cooling passage 105 is a passage on the blade leading edge side to communicate with a cooling passage 105*a* provided in a blade leading edge portion. Cooling air represented by arrow flows into the cooling passage 105 from a turbine rotor side to flow through the cooling passage 105*a* for cooling the blade leading edge portion and to flow out of a hole 110*a* of a blade tip portion and, at the same time, to flow out through film cooling holes 109 onto a blade surface for effecting a shower head film cooling of the blade leading edge portion. Cooling air represented by arrow 182 flows into the cooling passage 106 to flow through a cooling passage 106*a* provided in a blade interior and then turns at the blade tip portion to flow through a cooling passage 106*b* and turns again at a blade base portion to flow through a cooling passage 106*c* and to flow out of a hole 110*b* of the blade tip portion for cooling the blade interior and, at the same time, to flow out through film cooling holes 108 onto the blade surface for effecting a film cooling of the blade surface, as described later with respect to FIG. 8.

Cooling air represented by arrow 183 entering the cooling passage 107 flows through a cooling passage 107*a* provided in the blade interior and turns at the blade tip portion to flow through a cooling passage 107*b* and turns again at the blade base portion to flow through a cooling passage 107*c* and to flow out of a hole 110*e* of the blade tip portion. In this process of the flow, the cooling air represented by arrow 183 cools the blade interior and, at the same time, flows out through film cooling holes 111 onto the blade surface for effecting the film cooling of the blade surface, and also flows out through slots 112 provided in the blade trailing edge for cooling the blade trailing edge portion. Numerals 113*a* and 113*b* designate knife edge portions, which form sharp edges of the blade trailing edge and leading edge portions, respectively, to be positioned closely to a seal portion with adjacent stationary blades so as to maintain a good sealing ability thereat.

Figure 8:
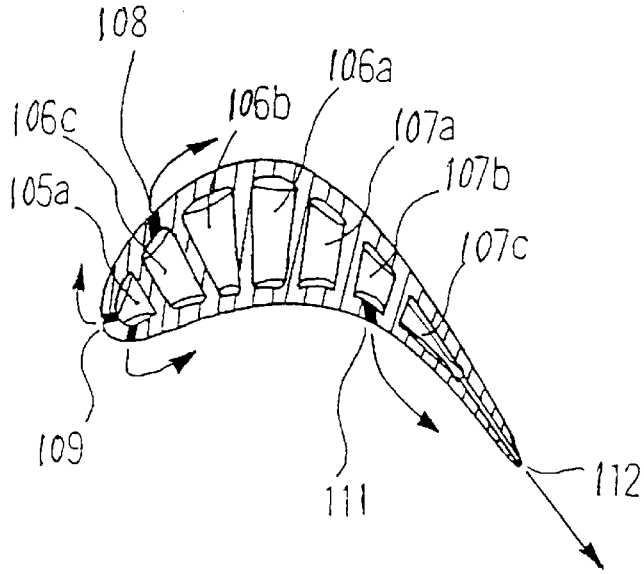
FIG. 8 is a cross sectional view taken on line A—A of FIG. 7.

FIG. 8 is a cross sectional view taken on line A—A of FIG. 7. As shown in FIG. 8, while omitted in FIG. 7, there are provided turbulators on both blade inner walls in each of the cooling passages 106*a* to 106*c* and 107*a* to 107*c*. In the cooling passage 105*a* on the blade leading edge side, there are provided a multiplicity of the film cooling holes 109 up and down along the blade leading edge portion so that the cooling air may be blown therethrough for effecting the film cooling of the blade surface. Also, up and down on the blade dorsal side of the cooling passage 106*c*, there are provided a multiplicity of the film cooling holes 108 so that the cooling air may be blown therethrough for effecting the film cooling of the blade surface on the blade dorsal side. Further, up and down on the blade ventral side of the cooling passage 107*b*, there are provided a multiplicity of the film cooling holes 111 so that the cooling air may be blown therethrough for effecting the film cooling of the blade rear side surface on the blade ventral side. Furthermore, there are provided a multiplicity of the slots 112 in the blade trailing edge and the cooling air is blown therethrough.

In the present fourth embodiment as described above, the cooling air enters an interior of the blade root portion 117 to flow through the cooling passages 105*a* and 106*a* to 106*c* for cooling the blade leading edge side and through the cooling passages 107*a* to 107*c* for cooling the blade trailing edge side. That is, the cooling air flows through two flow paths of a serpentine passage having an elongated cooling path in the blade so that the cooling effect may be enhanced. Further, there are provided the film cooling holes 109 on the blade leading edge side and the film cooling holes 108 on the blade dorsal side, as well as the film cooling holes 111 on the blade ventral side of the blade trailing edge portion, respectively, for effecting the film cooling of the blade surfaces so that the cooling effect may also be enhanced.

Figure 9:
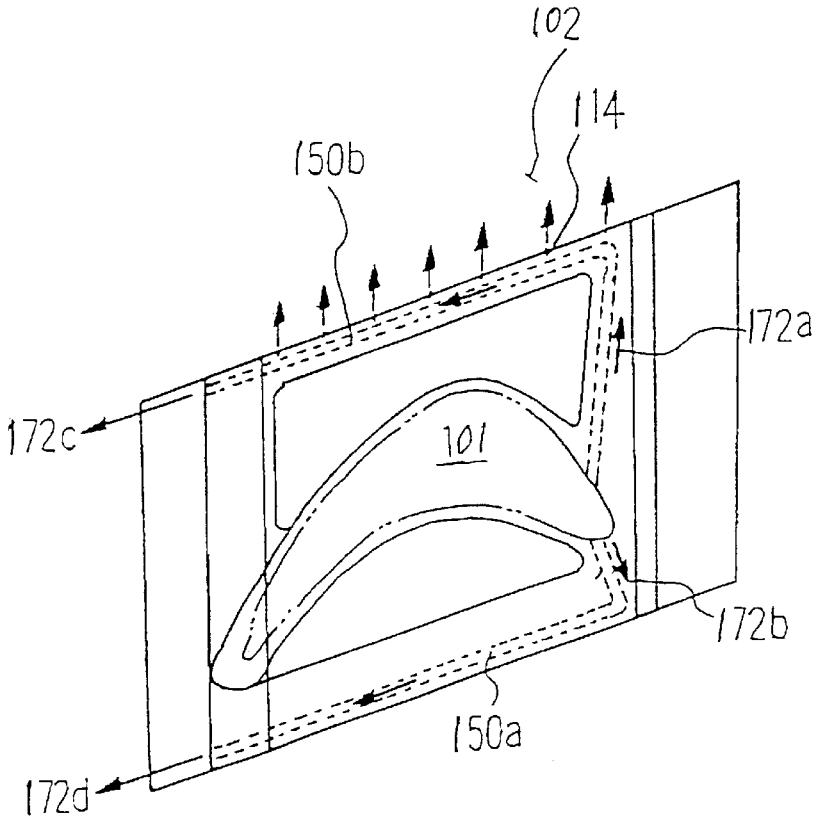
FIG. 9 is a cross sectional view taken on line B—B of FIG. 7.

FIG. 9 is a cross sectional view taken on line B—B of FIG. 7, wherein the right hand side of FIG. 9 is the front side, or the blade leading edge side, of the platform 102 and the left hand side of the same is the rear side, or the blade trailing edge side, of the platform 102. In FIG. 9, as described in the conventional case of FIG. 16, there are provided cooling passages 150*a*, 150*b* on both side end portions, or blade ventral and dorsal side end portions, of the platform 102 so that cooling air represented by arrows 172*a*, 172*b* may be led thereinto from the front portion of the platform 102 to flow out, as air represented by arrows 172*c*, 172*d*, through the rear portion of the platform 102 for cooling the front portion and both of the side portions of the platform 102. In the present fourth embodiment, there are further provided a plurality of cooling holes 114 arranged along the cooling passage 150*b* on the blade dorsal side end portion of the platform 102 so as to communicate with the cooling passage 150*b* and to open at a platform side end face on the blade dorsal side, and thereby the cooling air represented by arrow 172*a* is blown out onto the platform side end face of the blade dorsal side portion of the platform 102 and the cooling effect in this portion is enhanced.

According to the platform of the fourth embodiment, as mentioned above, in addition to the cooling passages 150*a*, 150*b* provided on the blade ventral and dorsal side end portions of the platform 102, the cooling holes 114 are provided on the blade dorsal side end portion of the platform 102, and thereby the cooling effect is enhanced. Also, as described with respect to FIG. 7, the recessed grooves 103*a*, 103*b* are provided on the blade leading edge and trailing edge side portions, respectively, of the platform 102, so that the blade fitting portions on the blade leading edge and trailing edge sides, where there is the severest thermal influence, are made to have a less thermal capacity so as to be balanced with the blade, and thereby the thermal stresses in this portion are made even and the thermal stress influences can be made smaller.

FIGS. 10(*a*)–10(*d*) show a structure of a blade tip thinned portion, wherein FIG. 10(*a*) is a cross sectional view of prior art and FIG. 10(*b*) is a plan view of the same, and wherein FIG. 10(*c*) is a cross sectional view taken on line C—C of the fourth embodiment of FIG. 7 and FIG. 10(*d*) is a plan view of the same. In the structure of a conventional blade 160, a blade tip thinned portion 173 is provided to rise from and along blade ventral and dorsal side tip edge portions, and a plug 174 of a rectangular shape for plugging up a rectangular opening provided during the course of the blade manufacturing is fitted into a central portion of a blade tip portion. In the blade 101 of the present invention, a blade tip thinned portion 115 is provided to rise from and along the blade dorsal side tip edge portion only with no blade tip thinned portion being provided on the blade ventral side, and yet sealing ability at the blade tip portion is maintained. Further, the opening provided during the course of the blade manufacturing is made of a circular shape, so that a plug 116 is also made of a circular shape and is fitted to the central portion of the blade tip portion by welding carried out from above. Accordingly, the structure of the present invention is made so that assembling thereof may be done easily.

According to the blade tip portion of the present fourth embodiment as mentioned above, the blade tip thinned portion on the blade ventral side is eliminated and only the blade tip thinned portion 115 is provided on the blade dorsal side, and thereby, while lowering of the sealing performance thereat is suppressed to the minimum, the structure is made simple so as to avoid damage due to high temperature thereat. Moreover, the opening at the blade tip portion is made smaller and has a circular shape, and the plug 116 is also made of a circular shape and is welded to thereby improve workability.

FIG. 11 is a view showing a shape of the fillet R of the fourth embodiment of FIG. 7 in comparison with a conventional case. As to the shape of the fillet R at the blade and platform fitting portions on the blade leading edge and trailing edge sides, in the conventional case shown by a dotted curve $Y_1$ and a solid curve $Y_2$, the fillet exhibits a combined smooth curve of $Y_1$ and $Y_2$, connecting a point of about 14 mm distance along the horizontal axis and a point of about 13 mm blade height along the vertical axis. On the contrary, in the present invention, the fillet R exhibits a combined line of an inclined straight line X and the curve $Y_2$, wherein the straight line X connects a point of about 20 mm blade height along the vertical axis and a point P on the curve $Y_2$ taken at a distance of about 5 mm along the horizontal axis, and the straight line X and the curve $Y_2$ join with each other smoothly at the point P. The fillet R, so made larger than the conventional fillet to have generally a curved portion partially including a straight line portion, is formed at and around two places on the blade leading edge and trailing edge sides, and other fillets of the blade fitting portions on the blade ventral and dorsal sides are made of the same shape as the conventional fillet.

By so making the fillet R larger on the blade leading edge and trailing edge sides, fillet thickness of this portion is increased and bending strength of this portion is enhanced so that the stress concentration may be avoided. Also, there is added the effect of the mentioned recessed grooves 103*a*, 103*b*, and thereby a flexibility against thermal stress is enhanced in the blade leading edge and trailing edge portions and occurrence of cracks can be suppressed.

According to the fourth embodiment as described above, the moving blade cooling structure is made such that the two serpentine flow paths, that is, the cooling passages 106*a* to 106*c* having two turns toward the blade leading edge side, and the cooling passages 107*a* to 107*c* having two turns toward the blade trailing edge side, are provided in the blade interior, so that the length of the flow paths is elongated and, moreover, the film cooling holes 109 of the blade leading edge, the film cooling holes 108 of the blade dorsal side leading edge portion, and the film cooling holes 111 of the blade ventral side rear portion are provided for cooling the blade 101. Also, the platform cooling structure is made such that cooling air is blown outside toward the blade dorsal side direction of the platform through the cooling holes 114 connected to the cooling passage 150*b*.

Further, the fillets R of the blade fitting portions on the blade leading edge and trailing edge sides are made larger than the conventional fillets as well as larger than the fillets of the blade ventral and dorsal sides, the recessed grooves 103*a*, 103*b* are provided in the platform 102 right under the fillets R, and the blade tip thinned portion 115 is provided only on the blade dorsal side with no blade tip thinned portion being provided on the blade ventral side.

By employing the mentioned cooling structures, the cooling effect of the entire blade 101 is enhanced and the thermal stresses at the blade fitting portions are lowered, and the averaged stress at the fillet R is lowered. Also, the bending strength is enhanced, the sealing performance at the blade tip is maintained and damage of the blade tip thinned portion due to high temperature can be avoided.

In FIGS. 12(*a*) and 12 (*b*), which are perspective views of a gas turbine moving blade comprising a shank portion thereof, FIG. 12(*a*) shows prior art and FIG. 12(*b*) shows a fifth embodiment according to the present invention comprising the recessed grooves of the fourth embodiment of FIG. 7 and an improvement in the shank portion. In the shank portion of the present fifth embodiment, the shank portion to fixedly support the platform 102 is elongated in its height direction and thinned in its width direction. That is, as compared with a conventional shank portion 195, having a height $H_0$ and a width $W_0$, of a moving blade 160 shown in FIG. 12(*a*), a shank portion 118 shown in FIG. 12(*b*) has a height H and a width W, wherein H is larger than $H_0$ ($H>H_0$) and W is smaller than $W_0$ ($W<W_0$), and H is larger than W. By so making the shank portion 118 longer and thinner, the shank portion 118 is given a flexibility against thermal stress changes and because of a damping effect thereof, the thermal stresses are dispersed and absorbed. Accordingly, occurrence of cracks due to thermal stresses can be suppressed. Constructions of other portions of the fifth embodiment are same as those of the fourth embodiment and the effect of the fourth embodiment is further enhanced by the fifth embodiment.

Figure 13A:
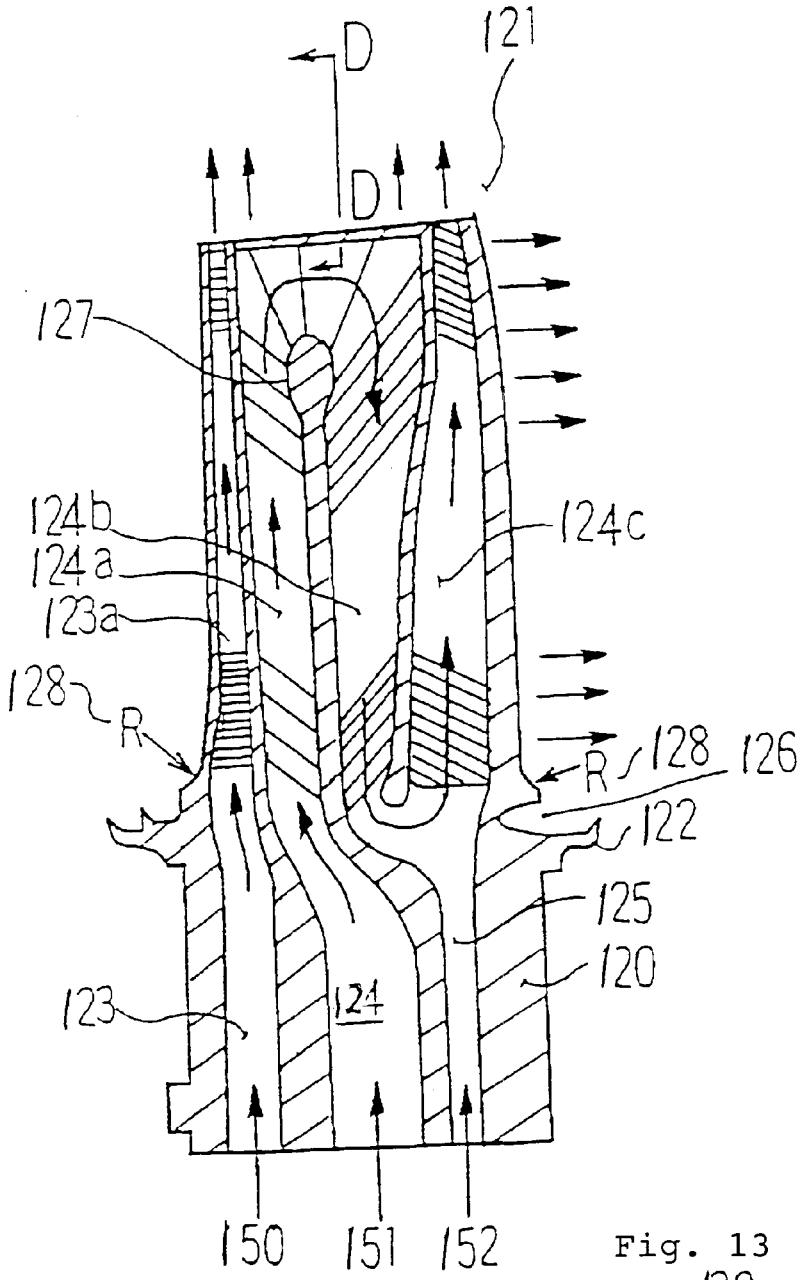
FIGS. 13(*a*) and 13(*b*) show a gas turbine second stage moving blade of a sixth embodiment according to the present invention, wherein FIG. 13(*a*) is a cross sectional view thereof and FIG. 13(*b*) is a cross sectional view taken on line D—D of FIG. 13(*a*).
Figure 13:
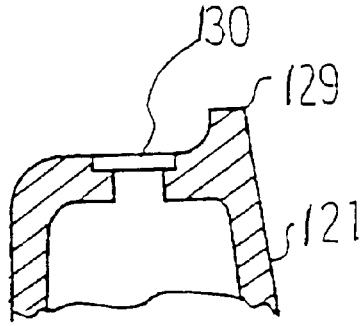

In FIGS. 13(*a*) and 13(*b*), which show a gas turbine second stage moving blade of a sixth embodiment according to the present invention, FIG. 13(*a*) is a cross sectional view thereof and FIG. 13(*b*) is a cross sectional view taken on line D—D of FIG. 13(*a*). In FIG. 13(*a*), numeral 121 designates the second stage moving blade and numeral 122 designates a platform. Cooling passages 123, 124, 125 are provided in a blade root portion 120. Cooling air represented by arrow 150 enters the cooling passage 123 to flow through a cooling passage 123*a* provided in the blade 121 for cooling a blade leading edge portion and flows out through a blade tip portion.

Cooling air represented by arrow 151 enters the cooling passage 124 to flow through a cooling passage 124*a* provided in the blade 121 and turns at the blade tip portion to flow through a cooling passage 124*b* and turns again at a blade base portion. At this time, the cooling air represented by arrow 151 and cooling air represented by arrow 152 entering the cooling passage 125 join together to flow through a cooling passage 124*c* and to flow out through the blade tip portion and, at the same time, to flow out through slots provided in a blade trailing edge. In this process of the flow, a portion of the cooling air flowing through cooling passage 124 flows out through the blade tip portion above the cooling passages 124*a* and 124*b*. Numeral 126 designates a recessed groove or cut-out portion, which has a smooth curved surface in an end face portion of a rear portion, or a blade trailing edge side portion, of the platform 122. Also, fillets R, 128, of blade fitting portions of blade leading edge and trailing edge portions have a curvature larger than that of fillets of other blade fitting portions. The shape of the fillet R is same as that described with respect to FIG. 10(*c*) and description thereof will be omitted.

In the gas turbine moving blade of the above-described structure, in addition to the cooling effect of the cooling passage 123*a* and the serpentine flow path of the cooling passages 124*a* to 124*c*, there is obtained a further effect by the recessed groove 126 on the rear portion of the platform 122 and the fillets R of the blade leading edge and trailing edge portions to reduce thermal stresses therearound and to enhance a strength of the fillets R against thermal stresses and occurrence of cracks can be prevented, in the same way as described with respect to the fourth embodiment. Also, cooling of the platform 122 is carried out by the same cooling structure as described with respect to the fourth embodiment shown in FIG. 9 and description thereof will be omitted.

In FIG. 13(*b*), a blade tip thinned portion 129 is provided to rise from and along a blade tip edge portion only on the blade dorsal side with no blade tip thinned portion being provided on the blade ventral side. Also, a plug 130 is made in a structure to be fitted by welding carried out from above, so that manufacture and assembly thereof are facilitated. By so providing the blade tip thinned portion 129 only on the blade dorsal side, sealing performance at the blade tip portion is maintained and yet damage of the blade thinned portion due to the high temperature can be suppressed.

According to the present sixth embodiment as described above, a sufficient cooling effect of the blade is obtained by the cooling passage 123*a* and the serpentine flow path of the cooling passages 124*a* to 124*c* and, in addition thereto, the strength against thermal stresses of the blade fitting portions on the blade leading edge and trailing edge portions is enhanced by the fillets R and the recessed groove 126, and damage of the blade tip thinned portion can be prevented as well. Further, as a cooling structure of the platform 122, the platform cooling structure of the fourth embodiment may be applied as it is.

While the preferred forms of the present invention have been described, it is to be understood that the invention is not limited to the particular constructions and arrangements herein illustrated and described but embraces such modified forms thereof as come within the scope of the appended claims.

What is claimed is:

1. A gas turbine moving blade comprising:

a platform including an interior platform cooling passage;

a blade fitted to said platform at a blade fitting portion of said blade on a trailing edge side of said blade, said blade including an interior blade cooling passage and also including cooling air blow holes provided in and around said blade, and said blade fitting portion including a fillet exterior with a curved surface; and a recessed portion in an end face portion of a rear side portion of said platform near said blade fitting portion, said recessed portion having a smooth curved surface and extending in an orthogonal direction relative to a turbine axial direction, wherein said cooling air blow holes include holes in a trailing edge of said blade, with one of said holes in the trailing edge of said blade being located in a hub portion of said blade and being a lowermost hole that is positioned beneath each other of said holes in the trailing edge of said blade, said lowermost hole having a cross-sectional area that is larger than that of said each other of said holes in the trailing edge of said blade, such that when said blade is to be cooled, cooling air is flown through said platform cooling passage, through said blade cooling passage, and out of said blade through said cooling air blow holes.

2. The gas turbine moving blade according to claim 1, wherein said blade is also fitted to said platform at a blade fitting portion of said blade on a leading edge side of said blade, and further comprising a coating of a heat resistant material on said blade and on said platform such that a thickness of said coating at said blade fitting portion at the leading edge of said blade and at said blade fitting portion at the trailing edge of said blade is thicker than that on other portions of said blade, and such that a thickness of said coating on said platform near and around the leading edge of said blade and the trailing edge of said blade is thinner than that on other portions of said platform.

3. The gas turbine moving blade according to claim 1, wherein said curved surface of said fillet exterior of said blade fitting portion defines an elliptical curve.

4. The gas turbine moving blade according to claim 1, further comprising:

a platform cooling air supply system connected with said platform cooling passage;

an opening/closing valve in said platform cooling air supply system for opening and closing said platform cooling air supply system; and a control unit for controlling said opening/closing valve so as to be closed while a gas turbine that includes the moving blade is being operated and so as to be opened for a predetermined time while the gas turbine is being stopped.

5. The gas turbine moving blade according to claim 1, further comprising a shank portion for fixedly supporting said platform, said shank portion having a height H in a turbine radial direction that is greater than a width W of said shank portion in a turbine rotational direction.

6. A gas turbine moving blade comprising:

a platform including an interior platform cooling passage in each of a blade ventral side end portion and a blade dorsal side end portion of said platform;

a blade fitted to said platform at each of a blade fitting portion of said blade on a trailing edge side of said blade and a blade fitting portion of said blade on a leading edge side of said blade, said blade including an interior blade serpentine cooling passage and also including cooling air blow holes provided in and around said blade, said blade serpentine cooling passage including two flow paths constructed and arranged such that when cooling air enters a central portion of a root portion of said blade the cooling air flows toward a trailing edge of said blade and also flows toward a leading edge of said blade, and each of said blade fitting portions including a fillet exterior with a curved surface;

a recessed portion in an end face portion of each of a rear side portion of said platform and a front side portion of said platform near said blade fitting portions, said recessed portion extending in an orthogonal direction relative to a turbine axial direction; and cooling holes provided in said platform and arranged along said platform cooling passage in the blade dorsal side end portion, each one of said cooling holes having one end in fluid communication with said platform cooling passage in the blade dorsal side end portion and another end opening at an end face on the blade dorsal side of said platform, such that when said blade is to be cooled, cooling air is flown through said platform cooling passage, through said blade serpentine cooling passage, and out of said blade through said cooling air blow holes.

7. The gas turbine moving blade according to claim 6, wherein said curved surface of the exterior of each of said blade fitting portions includes a combination of a linear portion and a curved portion.

8. The gas turbine moving blade according to claim 7, further comprising a shank portion for fixedly supporting said platform, said shank portion having a height H in a turbine radial direction that is greater than a width W of said shank portion in a turbine rotational direction.

9. The gas turbine moving blade according to claim 6, wherein said blade includes a thinned portion only at an edge portion of a tip portion of said blade on the dorsal side of said blade, and a circular plug in said tip portion.

10. The gas turbine moving blade according to claim 9, further comprising a shank portion for fixedly supporting said platform, said shank portion having a height H in a turbine radial direction that is greater than a width W of said shank portion in a turbine rotational direction.

11. The gas turbine moving blade according to claim 6, further comprising a shank portion for fixedly supporting said platform, said shank portion having a height H in a turbine radial direction that is greater than a width W of said shank portion in a turbine rotational direction.

12. A gas turbine moving blade comprising:

a platform including an interior platform cooling passage in each of a blade ventral side end portion and a blade dorsal side end portion of said platform;

a blade fitted to said platform at a blade fitting portion of said blade on a trailing edge side of said blade, said blade including an interior blade serpentine cooling passage and also including cooling air blow holes provided in and around said blade, said blade serpentine cooling passage including a flow path constructed and arranged such that when cooling air enters a central portion of a root portion of said blade the cooling air flows toward a trailing edge of said blade, and said blade fitting portion including a fillet exterior with a curved surface;

a recessed portion in an end face portion of a rear side portion of said platform near said blade fitting portion, said recessed portion extending in an orthogonal direction relative to a turbine axial direction; and cooling holes provided in said platform and arranged along said platform cooling passage in the blade dorsal side end portion, each one of said cooling holes having one end in fluid communication with said platform cooling passage in the blade dorsal side end portion and another end opening at an end face on the blade dorsal side of said platform, such that when said blade is to be cooled, cooling air is flown through said platform cooling passage, through said blade serpentine cooling passage, and out of said blade through said cooling air blow holes.

13. The gas turbine moving blade according to claim 12, wherein said blade includes a thinned portion only at an edge portion of a tip portion of said blade on the dorsal side of said blade, and a circular plug in said tip portion.

* * * * *